US007448715B2

(12) United States Patent
Nakayama

(10) Patent No.: US 7,448,715 B2
(45) Date of Patent: Nov. 11, 2008

(54) INK JET PRINTER

(75) Inventor: Koji Nakayama, Seki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 273 days.

(21) Appl. No.: 11/245,220

(22) Filed: Oct. 7, 2005

(65) Prior Publication Data

US 2006/0077220 A1 Apr. 13, 2006

(30) Foreign Application Priority Data

Oct. 8, 2004 (JP) ..... 2004-295993

(51) Int. Cl.
*B41J 29/393* (2006.01)

(52) U.S. Cl. ..... 347/19

(58) Field of Classification Search ..... 347/19, 347/42

See application file for complete search history.

(56) References Cited

U.S. PATENT DOCUMENTS

| | | | | |
|---|---|---|---|---|
| 5,568,172 | A * | 10/1996 | Cowger | 347/19 |
| 6,371,588 | B1 * | 4/2002 | Tsuruoka | 347/12 |
| 6,412,907 | B1 * | 7/2002 | Castelli et al. | 347/37 |
| 7,076,195 | B2 * | 7/2006 | Sakai | 399/301 |
| 2003/0128253 | A1 * | 7/2003 | Kitahara et al. | 347/42 |
| 2003/0151775 | A1 * | 8/2003 | Wang et al. | 358/300 |

FOREIGN PATENT DOCUMENTS

| | | |
|---|---|---|
| EP | 1 375 167 | 1/2004 |
| JP | 03-232644 | 10/1991 |
| JP | 09-169132 | 6/1997 |
| JP | 11170623 | 6/1999 |
| JP | 2004017505 | 1/2004 |

* cited by examiner

*Primary Examiner*—Matthew Luu
*Assistant Examiner*—Justin Seo
(74) *Attorney, Agent, or Firm*—Banner & Witcoff, Ltd.

(57) ABSTRACT

When there is a difference in moving speed of an endless belt in a widthwise direction, a printing sheet fed by this endless belt becomes inclined, and a pattern to be printed becomes inclined or distorted. To deal with this problem, a first detector for detecting moving speed is formed on one side edge of the endless belt, and a second detector for detecting moving speed is formed on the other side edge belt. Standard time is determined on the basis of a difference between the values detected by the first and the second detectors. The standard time is determined for each position along the width of the endless belt. Ink discharging time for each ink jet nozzle is determined on the basis of the standard time that has been determined, and on the basis of a pattern to be printed. The effects of the inclination of the printing sheet can be cancelled out, and a printed pattern can be obtained that is the same as when printing on a sheet that was not inclined.

11 Claims, 13 Drawing Sheets

INK JET PRINTER

CROSS-REFERENCE TO RELATED APPLICATION

This application claims priority to Japanese Patent Application No. 2004-295993, filed on Oct. 8, 2004, the contents of which are hereby incorporated by reference into the present application.

BACKGROUND OF THE INVENTION

1. Field of the Invention

The present invention relates to an ink jet printer.

2. Description of the Related Art

Line-type ink jet printers are provided with an endless belt for delivering a printing sheet, and with a print head for discharging ink. The endless belt has width, and the print head is provided with a plurality of ink jet nozzles. The plurality of nozzles are aligned in a widthwise direction of the endless belt. Below, a direction in which the endless belt moves will be termed a longitudinal direction, and a direction orthogonal to that direction (the widthwise direction of the endless belt) will be termed a widthwise direction.

By selecting which nozzle will discharge ink, it is possible to determine the position, in the widthwise direction of the printing sheet, of a point where the ink discharged from the nozzle will adhere. By adjusting the time at which the ink is discharged from the nozzle, it is possible to determine the position, in the longitudinal direction of the printing sheet, of a point where the ink discharged from the nozzle will adhere. By selecting which nozzle will discharge ink, and by adjusting the time at which the ink is discharged from that nozzle, it is possible to determine the position, in the widthwise and longitudinal directions of the printing sheet, of a point where the ink discharged from the nozzle will adhere. A desired pattern can be printed onto the printing sheet by controlling the position, in the widthwise and longitudinal directions of the printing sheet, of the points where the ink will adhere to the printing sheet.

In order to determine the position, in the longitudinal direction of the printing sheet, of the point where the ink adheres by means of adjusting the time at which the ink is discharged from the nozzle, it is necessary to adjust a moving speed of the endless belt that delivers the printing sheet so that this speed is a predetermined speed. If the actual moving speed of the endless belt is slower than the predetermined speed, printing will be performed further towards an upper edge of the printing sheet than desired. Alternatively, the longitudinal length of a pattern that is actually printed will be shorter than desired. If the actual moving speed of the endless belt is faster than the predetermined speed, printing will be performed further towards a lower edge of the printing sheet than desired. Alternatively, the longitudinal length of a pattern that is actually printed will be longer than desired.

The endless belt is usually wound across a pair of driving rollers. In this case, it is easy for the moving speed of the endless belt to vary due to slippage between the endless belt and the driving rollers, variation in the dimensions of an outer circumference of the driving rollers, variation in the position in which the driving rollers are disposed, variations in rotation speed of the driving rollers, etc. The moving speed of the endless belt may also vary due to the weight of the printing sheet being fed by this endless belt. When the actual moving speed of the endless belt differs from the predetermined speed, there is a discrepancy in the position, in the longitudinal direction of the printing sheet, of the points at which the ink adheres. There is thus the problem that printing quality deteriorates.

Techniques have been developed whereby, even if the moving speed of the endless belt varies, printing quality will not deteriorate. One example thereof is taught in Japanese Laid-Open Patent Application Publication No. 2004-17505. With an ink jet printer taught in that reference, the actual moving speed of an endless belt is detected. The time at which ink is discharged from nozzles is then adjusted on the basis of the detected moving speed. With this method, the points at which the ink adheres do not deviate from the desired position in the longitudinal direction of the printing sheet even if the moving speed of the endless belt differs from the predetermined speed.

BRIEF SUMMARY OF THE INVENTION

An endless belt has a width. The endless belt should be moving at the same speed irrespective of the position of this endless belt in the widthwise direction. However, the present inventors have ascertained by means of research that the moving speed of the endless belt may differ at differing positions in the widthwise direction. For example, when the endless belt is viewed from a plan face view, a right side edge may be moving more rapidly, or a left side edge may be moving more rapidly.

Further, it was understood that, if the moving speed of the endless belt differs according to the position in the widthwise direction, a printing sheet fed by that endless belt would be inclined. FIG. 12 shows an example thereof (A) shows a positioned state of a printing sheet 128 on an outer peripheral face of an endless belt 126. In this state, an upper edge 122 of the sheet 128 is parallel to a straight line 124 extending in the widthwise direction of the endless belt 126. The moving speed of the endless belt 126 may change along the widthwise direction 124. In FIG. 12, a case is shown in which a lower side edge has a moving speed of V1, an upper side edge has a moving speed of V2, and V1<V2. In this case, the sheet 128 being fed by the endless belt 126 will rotate in an anti-clockwise direction as shown by the arrow 129 in (B). The upper edge 122 of the sheet 128 is rotated by an angle β with respect to the straight line 124 extending in the widthwise direction of the endless belt 126.

When the sheet 128 inclines, a pattern to be printed on the sheet 128 will be inclined by the angle β with respect to the upper edge 122 of the sheet 128. The technique taught in Japanese Laid-Open Patent Application Publication No. 2004-17505 is unable to prevent this problem.

An aim of the present invention is to solve the problem wherein a pattern to be printed on a printing sheet is inclined with respect to this sheet when a moving speed of an endless belt varies in its widthwise direction.

An ink jet printer of the present invention has an endless belt having a width, a driving device for rotating the endless belt, and a print head. The print head is provided with a plurality of ink jet nozzles arranged along the width of the endless belt.

The ink jet printer of the present invention further has a first detector for measuring a moving speed of the endless belt at a first position, and a second detector for measuring a moving speed of the endless belt at a second position. The second position is separated from the first position along the width of the endless belt.

The ink jet printer of the present invention further has an ink discharge time determiner for determining the ink discharge time for each ink jet nozzle. The ink discharge time determiner determines the ink discharge time for each ink jet nozzle based on a position of the ink jet nozzle along the width of the endless belt, a difference between a value detected by the first detector and a value detected by the second detector, and a pattern to be printed.

The ink jet printer of the invention corrects the ink discharge time to cancel the inclination of the printing sheet being fed by the endless belt. In a case such as shown in FIG. 12, the leading edge 122 of the sheet 128 is ahead at the upper side and behind at the lower side. With the ink jet printer of the invention, the ink discharge time of the ink jet nozzle at the lower side is delayed with respect to the ink discharge time of the ink jet nozzle at the upper side. By correcting the ink discharge time based on the position of the ink jet nozzle along the width of the endless belt, and the difference between the value detected by the first detector and the value detected by the second detector, it is possible to discharge ink to points that are separated by intended distances, even if the leading edge 122 of the sheet 128 is inclined.

An ink jet printer of the present invention may have a standard time determiner. The standard time determiner determines standard time for each ink jet nozzle based on the position of the ink jet nozzle along the width of the endless belt, and the difference between the value detected by the first detector and the value detected by the second detector. The standard time is a time whereby the positional relationship of the printing sheet and the ink jet nozzle is adjusted to a predetermined positional relationship that was determined earlier. For example, it is a time when a leading edge of the printing sheet arrives directly below the nozzle.

When the ink jet printer includes the standard time determiner, the ink discharge time determiner determines the ink discharge time for each ink jet nozzle based on the standard time determined by the standard time determiner and the pattern to be printed.

FIG. 10(A) shows a case where a sheet 100 being delivered in the direction of the arrow 102 is to be printed by a print head 104. (A) shows an example where the sheet 100 is not inclined. An inclined line 106 can be printed on the paper 100 if a nozzle 105 that is located at a widthwise position W1 discharges ink at a time such that a point 110 on the sheet 100 is directly below the nozzle 105, and if a nozzle 107 that is located at a widthwise position W2 discharges ink at a time such that a point 112 on the sheet 100 is directly below the nozzle 107. In this case, an example is shown in which the inclined line 106 that is printed is inclined at an angle $\alpha$ with respect to an upper edge 108 of the printing sheet 100.

(B) and (C) show processes of determining the discharge time for the above purpose. A time t0 represents a time when the upper edge 108 of the printing sheet 100 is detected by a sensor 101. A distance L0 in the figure shows a distance from the sensor 101 to the nozzle 105 in a direction X (here, this is the same as a distance from the sensor 101 to the nozzle 107 in the direction X). If the moving speed of the endless belt is V0, the upper edge 108 of the printing sheet 100 is located directly below the nozzle 105 and the nozzle 107 using the time t0+(L0/V0). This time is one example of the standard time. If the sheet 100 is not inclined, the standard time for the nozzles 105, 107 are identical and does not change according to the position in the widthwise direction of the endless belt. The point 110 on the sheet 100 arrives directly below the nozzle 105 after L1/V0 has elapsed since the standard time, and consequently this time is the time for discharging the ink from the nozzle 105. The point 112 on the sheet 100 arrives directly below the nozzle 107 after L2/V0 has elapsed since the standard time, and consequently this time is the time for discharging the ink from the nozzle 107. If the standard time is determined in this manner, and the ink discharge time is determined based on this standard time, the desired pattern 106 can be printed.

FIG. 10(F) shows a case where the moving speed of the endless belt differs in the widthwise direction, and the sheet 100 becomes inclined while being delivered. In order for the ink to be sprayed from the nozzle 105 to the point 110 at a distance L1 from the upper edge 108 of the printing sheet 100, the ink may be discharged from the nozzle 105 after (L0/V1)+(L3/V1) +(L1/V1) has elapsed since the time when the sensor 101 detected the upper edge 108 of the printing sheet 100. In order for the ink to be sprayed from the nozzle 107 to the point 112 at a distance L2 from the upper edge 108 of the printing sheet 100, the ink may be discharged from the nozzle 107 after (L0/V2)+(L4/V2)+(L2/V2) has elapsed since the time when the sensor 101 detected the upper edge 108 of the printing sheet 100. Here, V1 is the moving speed at the lower side edge of the endless belt, and V2 is the moving speed at the upper side edge of the endless belt. Further, L3 and L4 are distances created by the inclination of the sheet 100. L3 and L4 are determined by their position in the widthwise direction and by the difference between V1 and V2. The greater the difference between V1 and V2, the greater L3 and L4.

Consequently, for the nozzle 105, the standard time may be corrected:

from t0+(L0/V0) to t0+(L0/V1)+(L3/V1)

and, for the nozzle 107, the standard time may be corrected:

from t0+(L0/V0) to t0+(L0/V2)+(L4/V2).

When the standard time is determined in the aforementioned manner, the ink discharge time may be determined as follows:

As to nozzle 105, the ink discharge time=the determined standard time+L1/V1: and as to nozzle 107, the ink discharge time=the determined standard time+L2/V2.

When the nozzles 105 and 107 discharge the ink at the ink discharge time determined in the aforementioned manner, the inclined line 106, which is inclined at the angle $\alpha$ with respect to the upper edge 108, can be printed on the inclined sheet 100. Here, the times of (L1/V1) and (L2/V2) to be added to the standard time are times determined on the basis of the pattern to be printed.

Here, L1/V1 may be approximately the same as L1/V0, and L2/V2 may be approximately the same as L2/V0. In this case, only the correction of the standard time for canceling the inclination of the printing sheet 100 may be required in determining the ink discharge time. Correction is not required for times determined based on the pattern to be printed.

The ink jet printer of the present invention may be provided with the standard time determiner for determining the standard time for each ink jet nozzle. This standard time determiner determines the standard time for each ink jet nozzle based on the position of the ink jet nozzle along the width of the endless belt, and based on the difference in moving speed. The time difference is thus determined for correcting the inclination of the sheet. The ink jet printer of the present invention may be provided with the ink discharge time determiner for determining the ink discharge time for each ink jet nozzle. The ink discharge time determiner determines the ink discharge time based on the standard time determined by the standard time determiner, and based on the pattern to be printed. With the ink jet printer of the present invention, even if the sheet 100 is inclined, the effects of that inclination can be cancelled out, and the desired pattern can be printed on the sheet.

In the above described aspect of the invention, the time required for canceling out the inclination of the printing sheet is calculated first, and the actual ink discharge time is calculated based on the corrected time and the pattern to be printed. This order may be altered. For instance, provisional ink discharge time may be calculated first based on the pattern to be printed, and the calculated provisional ink discharge time may be corrected to cancel out the inclination of the printing sheet Both procedures will give the same result.

With the ink jet printer of the present invention, the difference in the moving speed of the endless belt in the widthwise direction is calculated using the first detector and the second detector, the time difference necessary for canceling the inclination of the sheet that is caused by this difference in the moving speed is calculated, and the ink discharge time is determined. Even if the sheet is inclined, the effects of that inclination can be cancelled out, and the desired pattern can be printed on the printing sheet at the desired angle.

BRIEF DESCRIPTION OF THE DRAWINGS

FIG. 13(A) shows a case when is no difference in speed of the endless belt in the widthwise direction. FIG. 13(B) shows a case when is a difference in speed of the endless belt in the widthwise direction.

DETAILED DESCRIPTION OF THE INVENTION

Figure 1:
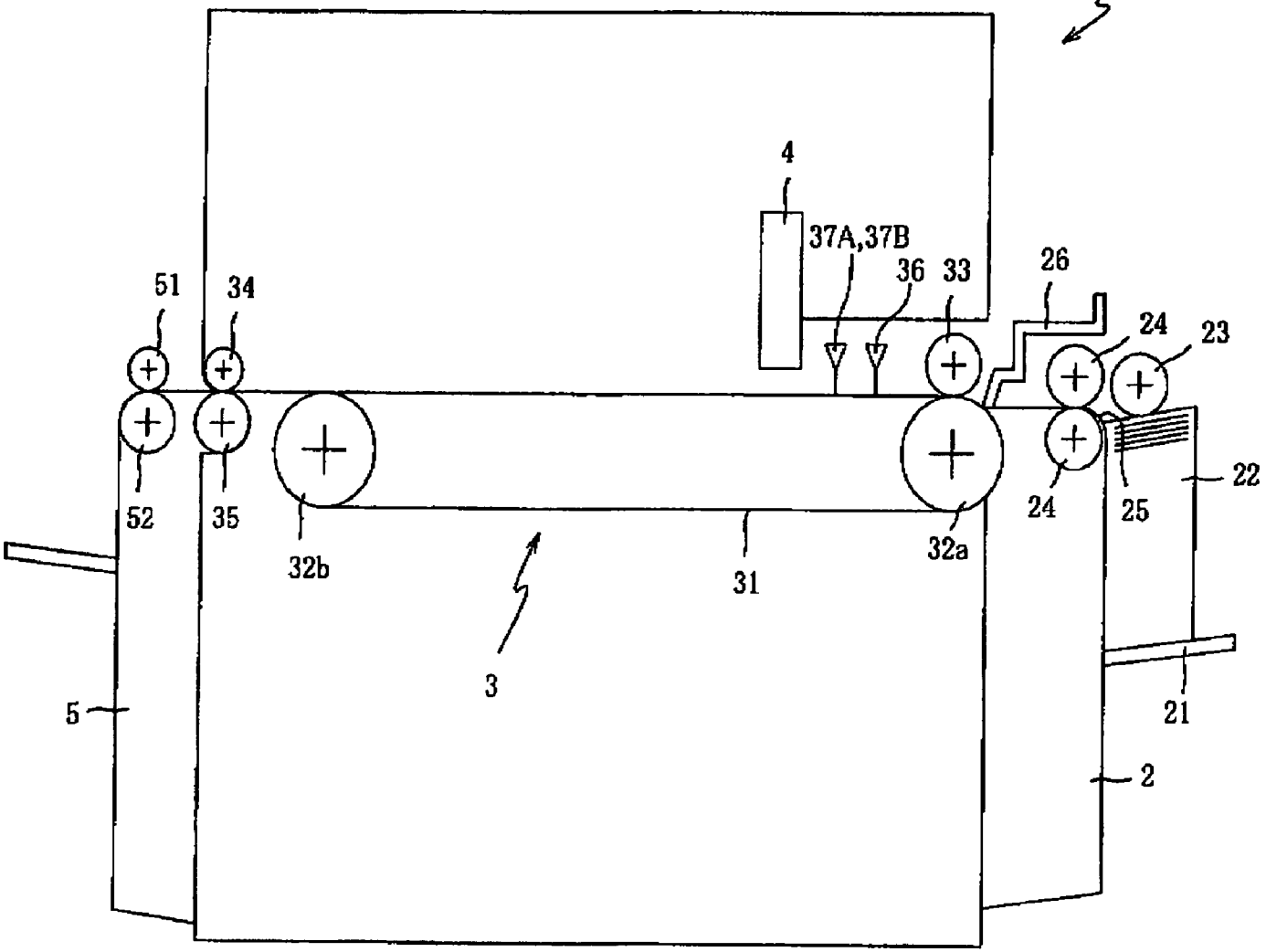
FIG. 1 shows a schematic view of an ink jet printer of a first embodiment.

A preferred embodiment of the present invention will now be described with reference to the attached figures. FIG. 1 shows a schematic view of an ink jet printer 1 of a first embodiment. The overall configuration of the ink jet printer 1 will be described first.

The ink jet printer 1 is provided with a supply part 2 for supplying printing sheets 22 to a main body, a feeding part 3 for feeding the printing sheet 22 supplied from the supply part 2, a print head 4 that prints the printing sheet 22 by discharging ink onto the printing sheet 22 that has been fed by the feeding part 3, and a stacker 5 for stacking the printing sheets 22 that have been printed by the print head 4.

The supply part 2 is provided with a tray 21 on which stacked printing sheets 22 are set, a pick up roller 23 that adjoins an uppermost sheet of the stack of printing sheets 22 set on the tray 21 and that delivers this uppermost sheet, and a pair of feeding rollers 24 that are located downstream from the pick up roller 23 (the left side in FIG. 1) and that grip the supplied printing sheet 22 and deliver it to the feeding part 3. A separating guide 25 is disposed between the pick up roller 23 and the pair of feeding rollers 24. This separating guide 25 prevents the delivery of two or more printing sheets that have been picked up simultaneously by the pick up roller 23. A correcting shutter 26 is disposed downstream from the pair of feeding rollers 24. In the case where the printing sheet 22 being gripped and delivered by the feeding rollers 24 is inclined, this correcting shutter 26 adjusts the position of the printing sheet 22 so that its upper edge is parallel with the widthwise direction of an endless belt 31 (to be described).

The feeding part 3 is provided with a pair of rollers 32*a* and 32*b*, the endless belt 31 wound between the rollers 32*a* and 32*b*, and a roller 33. The roller 33 faces the roller 32*a* that is at the upstream side (the right side in FIG. 1) with the endless belt 31 therebetween. Silicon processing has been performed on a face of the endless belt 31 at a side thereof that supports the printing sheet 22 (i.e. an outer peripheral face of the endless belt 31). The roller 32*a* is driven to rotate in an anti-clockwise direction by a motor (not shown). The roller 32*b* rotates freely. When the roller 32*a* is rotated in the anti-clockwise direction, an upper half of the endless belt 31 moves from the upstream side (the right side in FIG. 1) to the downstream side (the left side in FIG. 1).

The printing sheet 22 that has been delivered by the pair of feeding rollers 24 is pushed onto the outer peripheral face of the endless belt 31 by the roller 33. Since silicon processing has been performed on the outer peripheral face of the endless belt 31, the printing sheet 22 adheres thereto. The printing sheet 22 is transported downstream as the upper half of the endless belt 31 moves from the upstream side (the right side in FIG. 1) to the downstream side (the left side in FIG. 1).

The print head 4 is located above the endless belt 31. The print head 4 is fixed to an ink jet printer main body such that a lengthwise direction of the print head 4 extends parallel to a widthwise direction of the endless belt 31 (a direction perpendicular to the plane of the page of FIG. 1). A plurality of ink jet nozzles is formed in a lower face of the print head 4 that faces the endless belt 31. The ink jet nozzles are disposed along the widthwise direction of the endless belt 31 (perpendicular to the plane of the page of FIG. 1).

A minute gap is maintained between the upper side outer peripheral face of the endless belt 31 and the lower face of the print head 4. The printing sheet 22 that is adhering to the outer peripheral face of the endless belt 31 passes below the lower face of the print head 4. Ink is discharged from the ink jet nozzles formed in the lower face of the print head 4 towards the printing sheet 22 passing below this lower face. This ink adheres to an upper face of the printing sheet 22, thus printing the printing sheet 22.

A pair of paper discharge rollers 34 and 35 is disposed at the downstream side of the endless belt 31, these discharging into the stacker 5 the sheet 22 that has been delivered by the endless belt 31. The stacker 5 stacks the printing sheets 22 that have been printed, and is provided with discharging rollers 51 and 52. The discharging rollers 51 and 52 are disposed downstream from the paper discharge rollers 34 and 35. The discharging rollers 51 and 52 grip the printing sheet 22 that has been discharged from the feeding part 3, and deliver it to the stacker 5.

A paper sensor 36, a first detector 37A, and a second detector 37B are disposed at the upstream side of the endless belt 31. The sensors 36, 37A, and 37B are disposed facing the upper side outer peripheral face of the endless belt 31. The paper sensor 36 reverses its output at a time when an upper edge of the printing sheet 21 is transported to a position facing the paper sensor 36. The first detector 37A observes a detecting target 37*a* that adheres to a first side edge (an upper side edge in FIG. 3) of the endless belt 31, and thereby detects the moving speed of the upper side edge (in FIG. 3) of the endless belt 31. The second detector 37B observes a detecting target 37*b* that adheres to a second side edge (a lower side edge in FIG. 3) of the endless belt 31, and thereby detects the moving speed of the lower side edge (in FIG. 3) of the endless belt 31.

Figure 3:
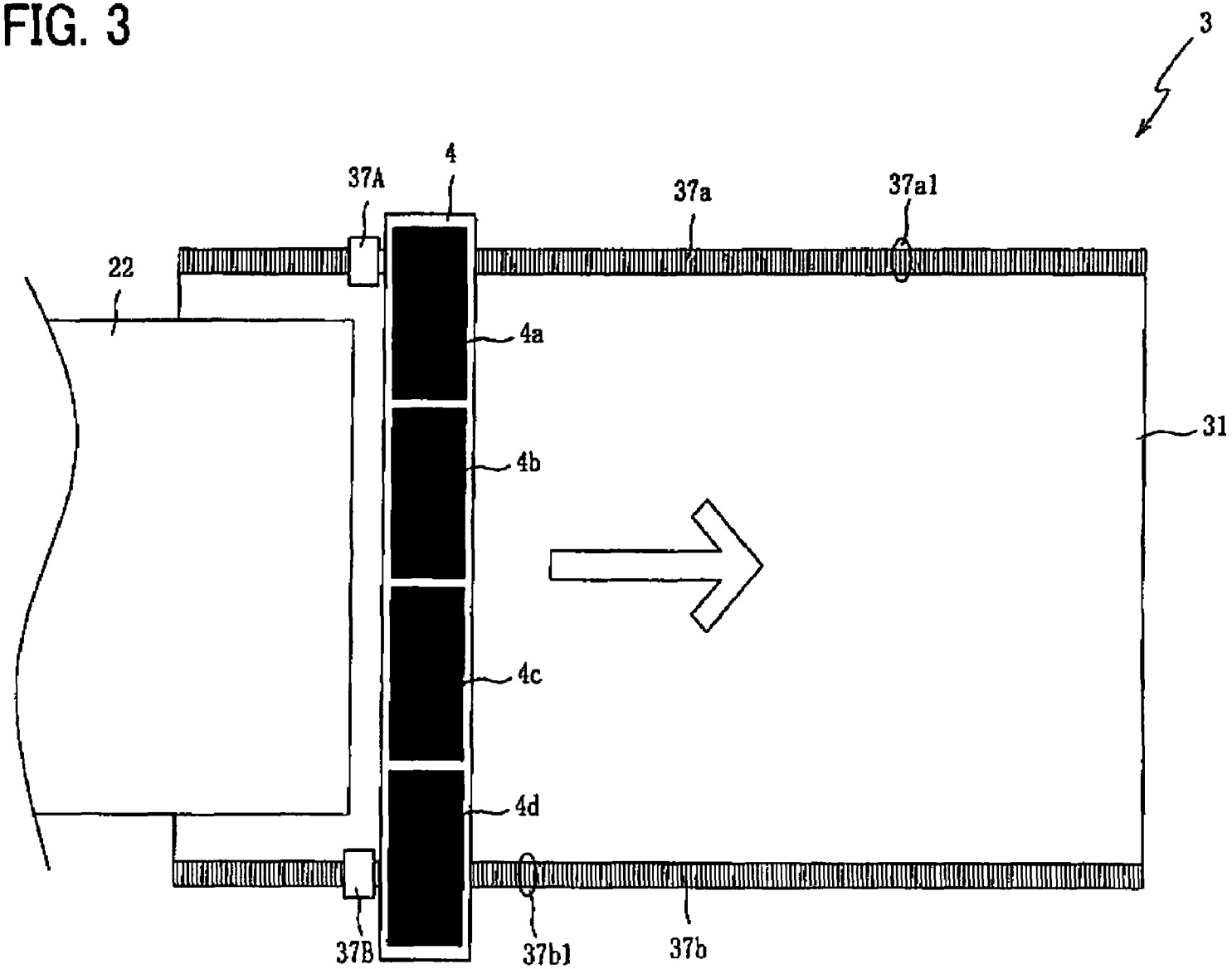
FIG. 3 shows a plan view of a feeding part and a printing sheet.

As shown in FIG. 3, the detecting targets 37*a* and 37*b* have a continuous pattern along the moving direction of the endless belt. In this pattern, black and white are reversed with a predetermined pitch. The detecting targets 37*a* and 37*b* thus change cyclically according to the predetermined pitch. The first detector 37A and the second detector 37B are sensors which emit light onto the detecting target 37*a* and 37*b* and receive reflected light. They reverse their output each time they detect a black part, and each time they detect a white part. The detecting targets 37*a* and 37*b* may equally well be configured so as to have concave and convex parts that change with a predetermined pitch. The first detector 37A and the second detector 37B may equally well be configured so as to emit a laser and detect its reflection.

The detecting targets 37*a* and 37*b* are belt shaped and, as shown in FIG. 3, are provided with connecting portions 37*a*1 and 37*b*1 that join together at a first edge side and a second edge side thereof. The continuous pattern of the first and second detecting targets 37*a* and 37*b* in which black and white are reversed is irregular at the connecting portions 37*a*1 and 37*b*1.

The print head 4 of the present embodiment is fixed to a printer main body. The print head 4 is a line type print head, and is configured so that, at the time of maintenance, it can be moved to a position in which a maintenance means (not shown, this maintenance means being a cap, a pump, etc. used for a purging operation) is located.

One print head 4 is present in the present embodiment. However, it is equally possible to provide a print head for discharging magenta ink, a print head for discharging yellow ink, a print head for discharging cyan ink, and a print head for discharging black ink. Color printing of the printing sheet 22 can be performed by aligning these four print heads in the feeding direction of the printing sheet 22.

Figure 2:
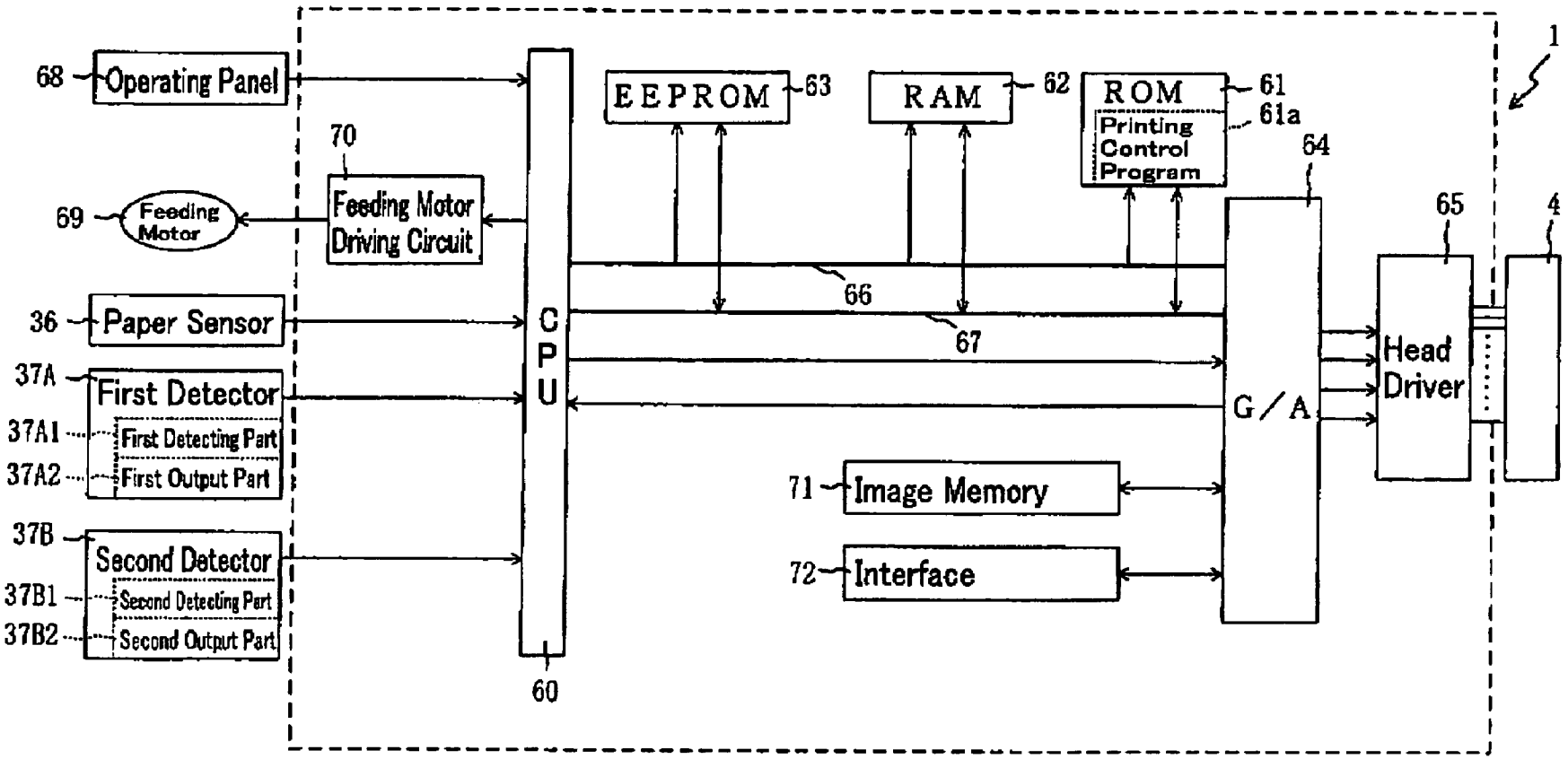
FIG. 2 shows a schematic block view of electrical circuit configuration of the ink jet printer of the first embodiment.

FIG. 2 shows a schematic block view of electrical circuit configuration of the ink jet printer 1. The ink jet printer 1 has a microcomputer (CPU) 60 on one chip, a ROM 61, a RAM 62, an EEPROM 63, a gate array (G/A) 64, a head driver 65, etc. The CPU 60, ROM 61, RAM 62, EEPROM 63, gate array 64, and head driver 65 are connected via an address bus 66 and a data bus 67.

The CPU 60 controls ink discharge, the detection of the remaining quantity of ink in a cartridge, etc. in accordance with a printing control program stored in advance in the ROM 61. Further, the CPU 60 generates discharge time signals and reset signals, and transmits these signals to the gate array 64 (to be described).

The CPU 60 is connected with an operating panel 68 for allowing a user to input printing instructions or the like, a feeding motor driving circuit 70 for operating a feeding motor 69 that feeds the printing sheet 22, the paper sensor 36 for detecting a tip edge of the printing sheet 22, the first detector 37A, and the second detector 37B. The CPU 60 controls the operation of all these devices. The first detector 37A has a first detecting part 37A1 that detects the moving speed of the endless belt 31 at a first position (to be described), and a first output part 37A2 that outputs a detected signal. The second detector 371 has a second detecting part 37B1 that detects the moving speed of the endless belt 31 at a second position (to be described), and a second output part 37B2 that outputs a detected signal. The first detecting part 37A1 and the second detecting part 37B1 are formed from, for example, sensors which emit light and receive reflected light.

The ROM 61 is a non-rewritable nonvolatile memory that stores a printing control program 61*a*, other data with fixed values, etc. The RAM 62 is a rewritable volatile memory that temporarily stores all types of data, etc. The EEPROM 63 is a non-rewritable nonvolatile memory. The printing control program 61*a* is executed by the CPU 60, and controls the ink discharge time, etc. on the basis of the differences in moving speed of the endless belt 31 detected by the first and second detectors 37A and 37B.

The gate array 64 outputs the following signals to the head driver 65: standard time transmitted from the CPU 60, image forming data (a driving sign), a transmission clock CLK synchronized with the image forming data, a latch signal, a parameter signal for generating standard printing wave form signals, and a discharging time signal output at a constant interval. The image forming data is for forming a pattern on the printing sheet 22, this pattern being described in image data stored in an image memory 71. Further, the gate array 64 also stores, in the image memory 71, image data transmitted from a personal computer or the like via an interface 72.

The head driver 65 is a driving circuit for applying driving pulses to the print head 4 in accordance with the signals output from the gate array 64. The head driver 65 applies the driving pulses to driving elements that correspond to each of the nozzles of the print heads 4. The driving elements operate in response to the driving pulses, and ink is discharged from the nozzles.

Figure 4:
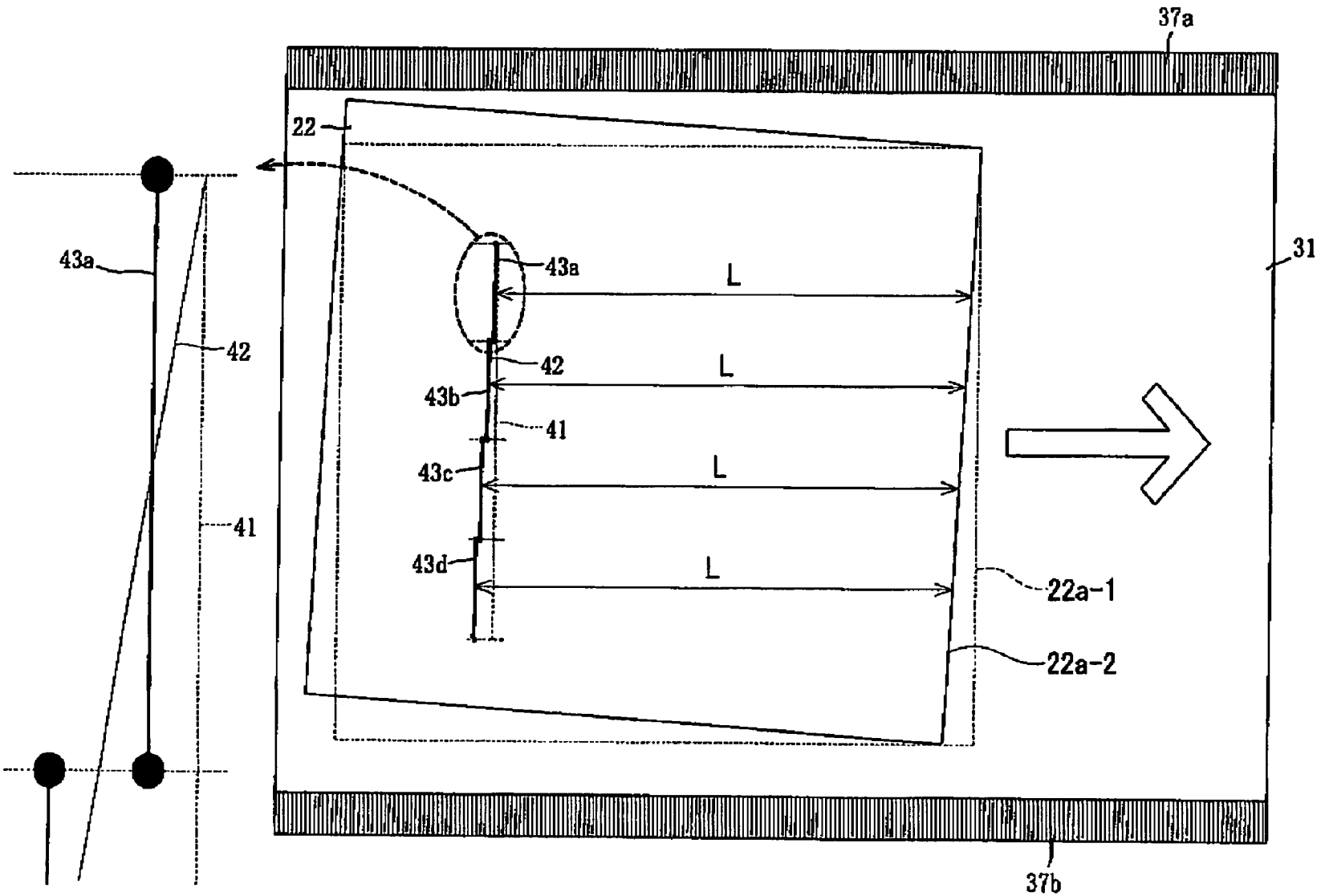
FIG. 4 shows a plan view of an endless belt and an inclined printing sheet.

The feeding of the printing sheet 22 that is supported on the endless belt 31 will be described with reference to FIGS. 3 and 4. FIG. 3 shows a plan view of the feeding part 3 and the printing sheet 22. FIG. 4 shows a plan view of the endless belt 31 and the printing sheet 22 that is inclined.

As shown in FIG. 3, the belt-shaped first detecting target 37*a* is fixed along the first side edge of the endless belt 31. The belt-shaped second detecting target 37*b* is fixed along the second side edge of the endless belt 31. The first detector 37A is positioned facing the first detecting target 37*a*, and the second detector 37B is positioned facing the second detecting target 37*b*. The first detector 37A and the second detector 371B are both disposed at the upstream side of the print head 4 (the left side in FIG. 3). The first detector 37A and the second detector 37B are disposed on a straight line in the widthwise direction of the endless belt 31. The first detector 37A and the second detector 37B are mutually separated by a distance equivalent to the width of the endless belt 31.

When the endless belt 31 moves, the black and white continuous pattern of the first and second detecting targets 37*a* and 37*b* pass positions corresponding to the first and second detectors 37A and 37B, whereupon the output of the first and second detectors 37A and 37B reverses cyclically. The moving speed of the endless belt 31 is detected from the period of this reversal. The first detector 37A detects a moving speed V1 at the first side edge of the endless belt 31. The second detector 37B detects a moving speed V2 at the second side edge of the endless belt 31. The position at which the first detector 37A detects the moving speed (the position at which the laser is shone) is termed the first position, and the position at which the second detector 378 detects the moving speed is termed the second position. The first position and the second position are disposed in a straight line in the widthwise direction of the endless belt 31, and are mutually separated by a distance equivalent to the width of the endless belt 31.

Since the first position and the second position are disposed at both widthwise edges of the endless belt 31, this allows the detection of maximum difference in moving speed if the moving speed of the endless belt is not uniform in the widthwise direction. If the moving speed of the endless belt is not uniform in the widthwise direction due to the endless belt 31 not having a uniform thickness, due to there being a difference in dimensions of the rollers 32*a* and 32*b* (see FIG. 1), or due to there being a discrepancy in the positional relationship of the rollers 32*a* and 32*b*, the maximum difference in moving speed in the widthwise direction can be detected by the first and second detectors 37A and 37B. The first and second detectors 37A and 37B detect the difference in moving speed with a high degree of accuracy.

The ink jet printer 1 can receive printing sheets 22 whose sheet width is narrower than the width of the endless belt 31. Consequently, in the case where a printing sheet 22 with maximum width is to be printed, the first detecting target 37*a* and the second detecting target 37*b* are still not covered by this printing sheet 22. In the case where the maximum size printing sheet 22 is to be printed, the moving speed of the endless belt 31 can still be detected at the first and the second positions.

The first and second detecting targets 37*a* and 37*b* are fixed to the outer peripheral face of the endless belt 31 to which the printing sheet 22 is adhering. As a result, the moving speed of the printing sheet 22 can be detected even in the case where the thickness of the endless belt 31 is not uniform.

Since the first and second detecting targets 37*a* and 37*b* are fixed to the endless belt 31, it is not necessary to manufacture the endless belt 31 and the fist and second detecting targets 37*a* and 37*b* in a unified manner. The manufacturing cost of the endless belt 31 can thus be reduced.

The print head 4 is provided with a plurality of rows of nozzles that are aligned in the widthwise direction of the endless belt 31. The print head 4 is provided with a plurality of these rows. The nozzles are grouped into four units 4*a*, 4*b*, 4*c*, and 4*d* according to their position in the widthwise direction of the endless belt 31.

The standard time (to be described) must essentially be determined for each nozzle on the basis of its position in the widthwise direction of the endless belt 31. However, in the present embodiment, the standard time is determined for each of the units 4*a*, 4*b*, 4*c*, and 4*d*. Considerable calculating time is thus spared compared to the case where the standard time is determined for each nozzle. Furthermore, inclination of the printing sheet is not particularly large. It is consequently possible, by determining the standard time for the four units, to compensate for the inclination of the printing sheet to the extent that effects caused by the inclination of the printing sheet are virtually absent.

When the printing sheet 22, which is being fed from the supply part 2 side (the left side in FIG. 3) in the direction of the arrow (towards the right in FIG. 3) and which is adhering to the outer peripheral face of the endless belt 31, passes under the ink jet nozzles of the print head 4, ink is discharged from the print head 4, thus printing the printing sheet 22.

When there is a difference in the moving speed across the widthwise direction (the up-down direction of FIG. 3) of the endless belt 31 (this difference being due to the endless belt 31 not having a uniform thickness, due to there being a difference in the dimensions of the rollers 32*a* and 32*b* (see FIG. 1), or due to there being a discrepancy in the positional relationship of the rollers 32*a* and 32*b*, etc.) such that, for example the moving speed (v1) of the first detecting target 37*a* is greater than the moving speed (v2) of the second detecting target 37*b*, the printing sheet 22 becomes relatively inclined at this juncture with respect to the ink nozzles of the print head 4. This is shown by the solid line in FIG. 4. If the ink is discharged onto this inclined printing sheet 22, a pattern 41 printed on the printing sheet 22 will be inclined with respect to the printing sheet 22, thus causing a deterioration in printing quality. The broken line 41 in FIG. 4 shows a pattern printed when the inclination of the printing sheet 22 was not corrected. The pattern 41, which originally should have been printed parallel with the upper edge of the printing sheet 22, is inclined towards an upper edge 22*a*-2 of the printing sheet 22.

In controlling ink discharge time, (to be described), the inclination that the printing sheet 22 will develop is predicted, and the ink discharge time is corrected so as to compensate for the inclination. In the example shown in FIG. 4, the result is shown of when the ink discharge time of the units 4*a*, 4*b*, 4*c*, and 4*d* was corrected so that the following are equivalent: a distance L from a center of a line segment 43*a* being printed by the unit 4*a* to the upper edge 22*a*-2 of the printing sheet 22, a distance L from a center of a line segment 43*b* being printed by the unit 4*b* to the upper edge 22*a*-2 of the printing sheet 22, a distance L from a center of a line segment 43*c* being printed by the unit 4*c* to the upper edge 22*a*-2 of the printing sheet 22, and a distance L from a center of a line segment 43*d* being printed by the unit 4*d* to the upper edge 22*a*-2 of the printing sheet 22. In this case, a line segment 42 that links these centers is parallel to the upper edge 22*a*-2 of the printing sheet 22. The line segment configured by the entirety of the line segments 43*a*, 43*b*, 43*c*, and 43*d* is very similar to the line segment 42 that is parallel to the upper edge 22*a*-2 of the printing sheet 22, and thus the effects caused by the inclination of the printing sheet 22 can essentially be cancelled out.

It is possible to print the ideal line segment 42 by correcting the ink discharge time for each nozzle so as to cancel out the effects caused by the inclination of the printing sheet 22. However, if the ink discharge time is to be corrected for each ink jet nozzle, the correction process requires an increased amount of calculation. In the present embodiment, the discharge time is corrected using the nozzles that have been grouped into the four units 4*a*, 4*b*, 4*c*, and 4*d*. The calculation load is thus reduced, and the production costs of software and hardware used for calculating the correction is thus reduced.

In the present embodiment, the nozzles have been classified into four groups. However, the number of groups is not restricted to four. If many groups are formed, the control load is increased, and if too few groups are formed, the effects caused by the inclination of the printing sheet 22 are not cancelled out. It is desirable that the discharging nozzles form between four to six groups.

Next, the control of the printing process will be described with reference to FIG. 5. During the description of the printing process, reference will be made as required to FIGS. 6 to 9.

Figure 5:
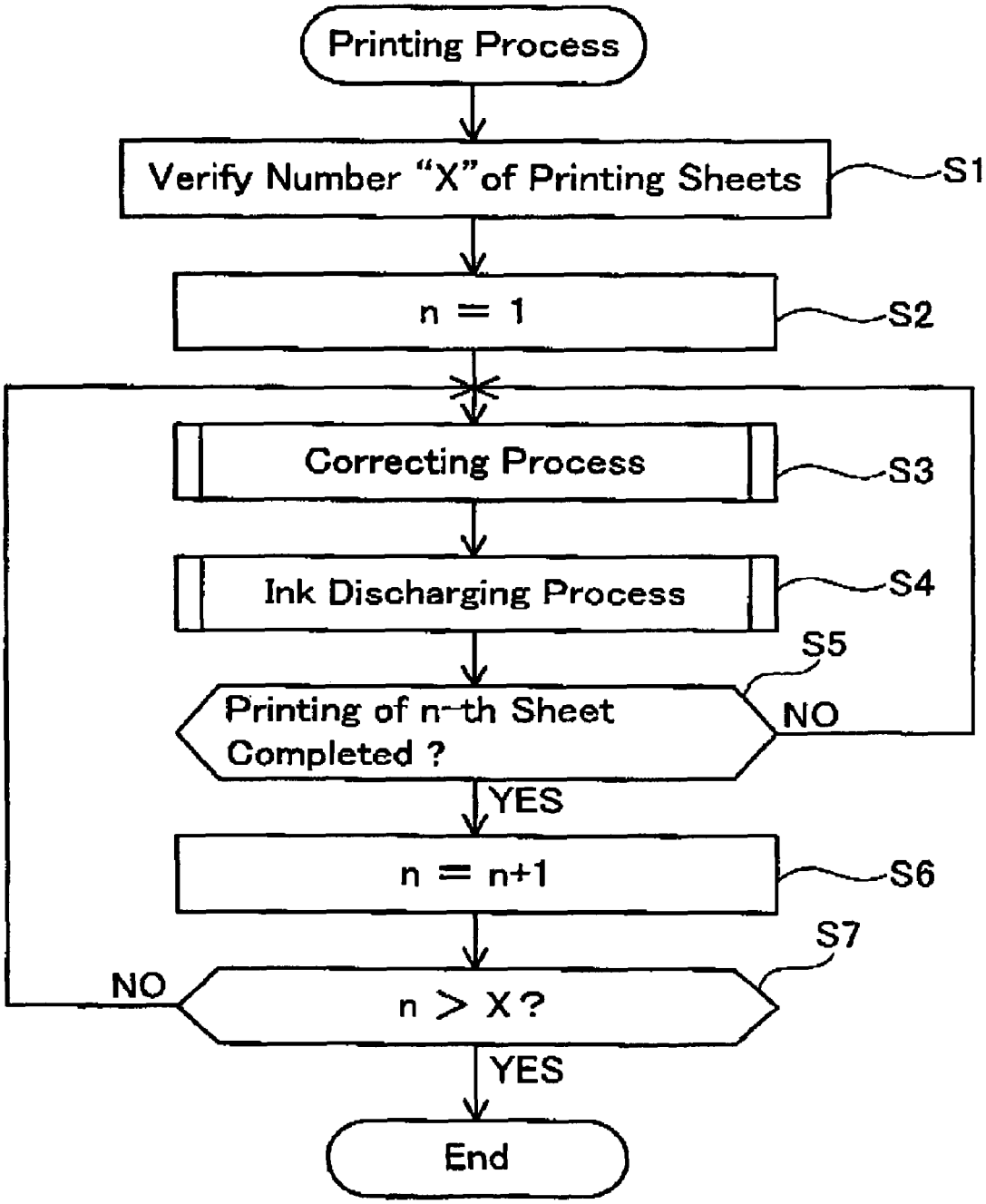
FIG. 5 shows a flow chart of a printing process.

FIG. 5 shows a flow chart of the printing process. In the printing process, a pattern is printed on the printing sheet 22 supplied from the supply part 2 (see FIG. 1).

In this process, a number "X" of printing sheets 22 to be printed is verified (S1). Specifically, the number "X" of printing sheets is determined on the basis of the image data transmitted via the interface 72 from the personal computer or the like.

Next, since the printing process will be of a first sheet of the printing sheets 22, let n=1 (S2).

Next, a correcting process is performed (S3) in which any discrepancy between a detected speed and an actual speed is corrected, this discrepancy occurring due to the detection of the first and second connecting portions 37*a*1 and 37*b*1 which are present from the time when the first and second detecting targets 37*a* and 37*b* were fixed to the endless belt 31. The sequence of the correcting process will be described with reference to FIGS. 6 and 7.

Figure 6:
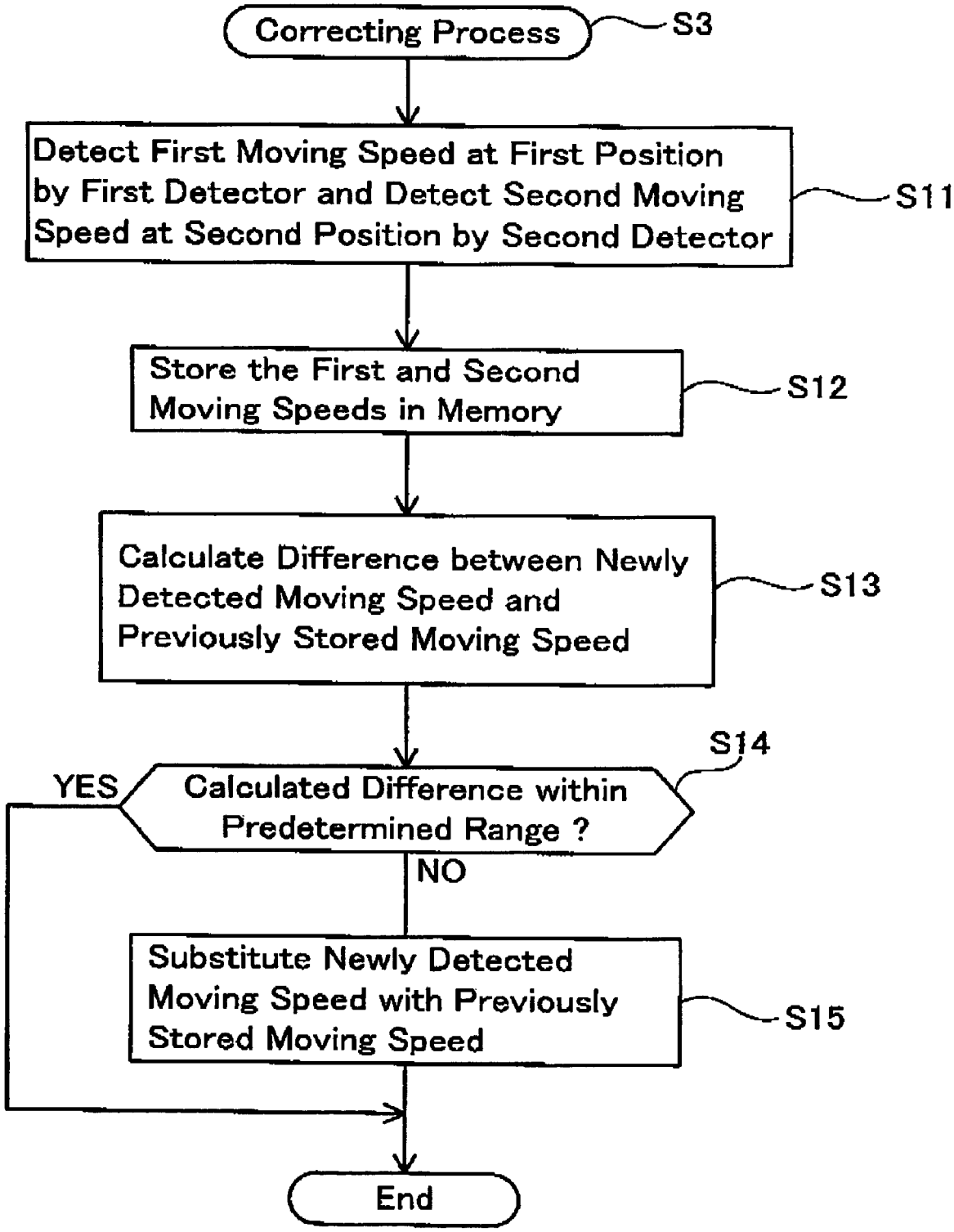
FIG. 6 shows a flow chart of a correcting process executed when connecting portions have been detected.
Figure 7:
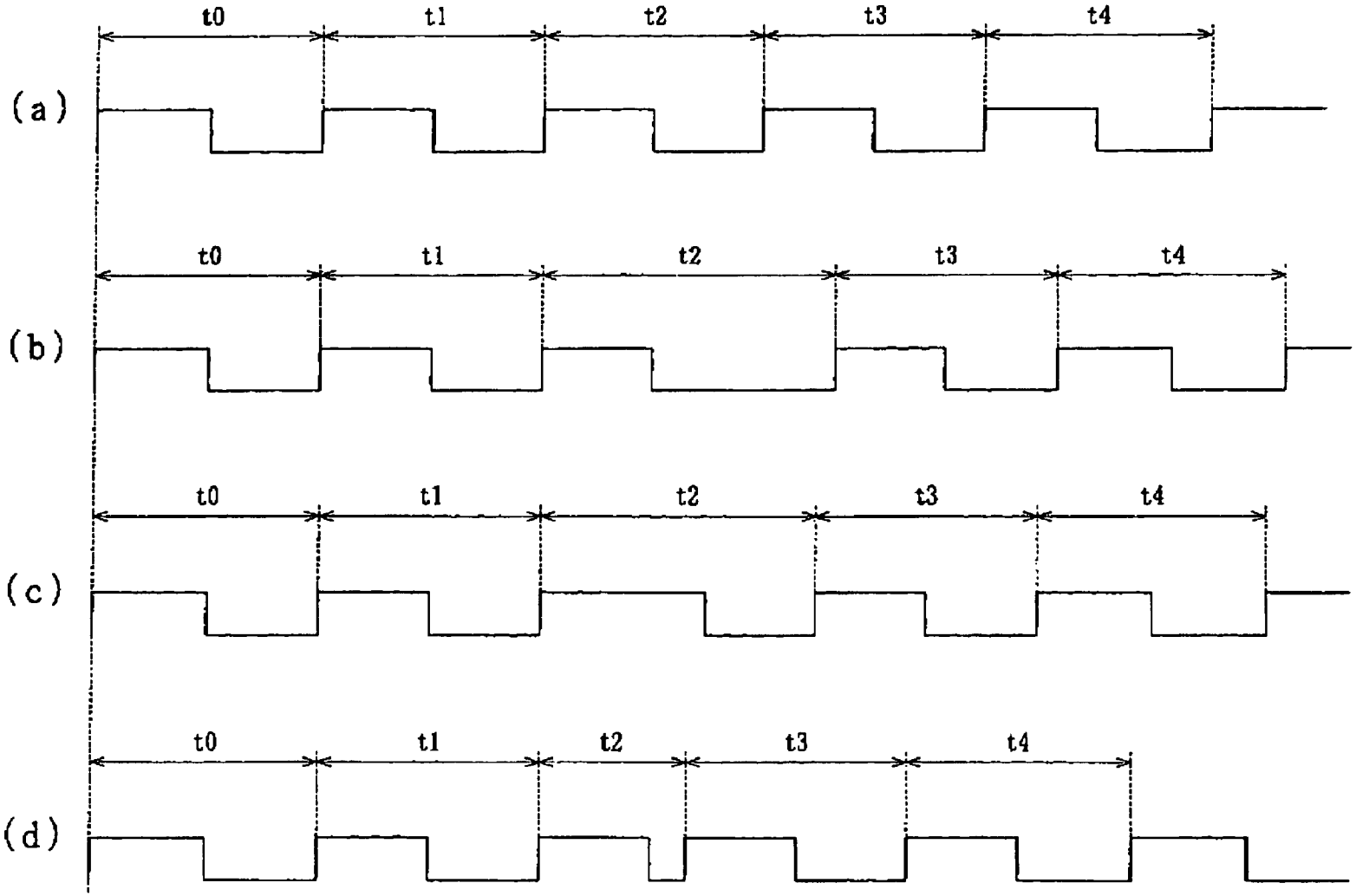
FIG. 7 shows signal wave forms output by a detector.

FIG. 6 shows a flow chart of the correcting process. FIG. 7 shows examples of signals obtained when the connecting portions 37*a*1 and 37*b*1 are detected. First, the signals obtained when the connecting portions 37*a*1 and 37*b*1 are detected will be described in detail with reference to FIG. 7. FIG. 7 shows signal wave forms output by the first and second output parts 37A2 and 37B2 of the first and second detectors 37A and 37B. FIG. 7(*a*) shows the signal wave forms obtained when what is being detected is the range of the first and second detecting targets 37*a* and 37*b* that does not contain the first or second connecting portions 37*a*1 or 37*b*1 FIGS. 7(*b*) to (*d*) show the signal wave forms obtained when what is being detected is the range of the first and second detecting targets 37*a* and 37*b* that does contain the first or second connecting portions 37*a*1 or 37*b*1.

The first and second detecting targets 37*a* and 37*b* comprise a continuous black and white pattern. The first or second detector 37A or 37D outputs a low signal when it detects white, and outputs a high signal when it detects black.

The signal wave forms shown in FIG. 7(*a*) are the signal wave forms obtained when what is being detected is the range of the first and second detecting targets 37*a* and 37*b* that does not contain the first or second connecting portions 37*a*1 or 37*b*1. In the case where the sum of the high signal output time and low signal output time are t0, t1, t2, t3, and t4, then in the case where the moving speed of the endless belt 31 is constant, t0, t1, t2, t3, and t4 are all equivalent. Moreover, in the case where the moving speed of the endless belt 31 is not constant, t0, t1, t2, t3, and t4 differ from one another, but there is no large difference between adjoining times. Furthermore, the moving speed of the endless belt 31 can be found from the distance between the black and white of the detecting targets 37*a* and 37*b*, and from the time at which the distance between the black and white was detected (for example, t0, t1 . . . ).

FIG. 7(*b*) shows the signal wave forms obtained when what is being detected is the range of the first and second detecting targets 37*a* and 37*b* that contains the first and second connecting portions 37*a*1 and 37*b*1, the first and second detecting targets 37*a* and 37*b* having been attached such that the first edge thereof is white and the second edge thereof is also white. As shown by t2, the time where the low signal is output is longer than the time where the low signal is output in t0, t1, etc. If the moving speed of the endless belt 31 is determined on the basis of t2, an erroneous moving speed will be detected.

FIG. 7(*c*) shows the signal wave forms obtained when what is being detected is the range of the first and second detecting targets 37*a* and 37*b* that contains the first and second connecting portions 37*a*1 and 37*b*1, the first and second detecting targets 37*a* and 37*b* having been attached such that the first edge thereof is black and the second edge thereof is also black. As shown by t2, the time where the high signal is output is longer than the time where the high signal is output in t0, t1 etc. If the moving speed of the endless belt 31 is determined on the basis of t2, an erroneous moving speed will be detected.

FIG. 7(*d*) shows the signal wave forms obtained when what is being detected is the range of the first and second detecting targets 37*a* and 37*b* that contains the first and second connecting portions 37*a*1 and 37*b*1, the first and second detecting targets 37*a* and 37*b* having been attached such that the first edge thereof is black and the second edge thereof is white. t2 is shorter than t0, t1, etc. If the moving speed of the endless belt 31 is determined on the basis of t2, an erroneous moving speed will be detected.

Next, the sequence of the correcting process will be described with reference to FIG. 6. As shown in FIG. 6, in the correcting process, the moving speeds detected by the first and second detectors 37A and 37B respectively in the first and the second positions are first confirmed (S11). The difference in speed between the two side edges of the endless belt 31 can thus be calculated. Next, the moving speeds detected by the first and second detectors 37A and 37B respectively are stored in the memory (the RAM 62) (S12). Next, the difference is calculated between the moving speeds confirmed in S11 and the moving speeds stored in the memory from a previous correcting process (S13). The previous time refers, in for example FIG. 7(*a*), to the moving speed calculated from t0 rather than the moving speed calculated from t1.

Next, it is determined whether the difference in the moving speed that has been calculated is within a predetermined range (S14). In the case where the difference in moving speed is within the predetermined range (S14: Yes), it can be decided that the connecting portions 37*a*1 and 37*b*1 are not being detected. Alternatively, even if the connecting portions 37*a*1 and 37*b*1 are being detected, it is a case where this will almost never cause erroneous detections. In this case, it is not necessary to correct the signals, and the correcting process ends.

In the case where the connecting portions 37*a*1 and 37*b*1 are being detected and yet this will almost never cause erroneous detections, this is a case where the changing pitch of black and white is being maintained at the connecting portions 37*a*1 and 37*b*1 of the detecting targets 37*a* and 37*b*.

In the case where the changing pitch of black and white at the connecting portions 37*a*1 and 37*b*1 of the detecting targets 37*a* and 37*b* differs from the remainder, step S14 is No. In this case, the previous signal wave form is substituted for the signal that has been detected, thereby preventing erroneous detection (S15). For example, in the case of FIG. 7(*b*), t2 represents the connecting portions 37*a*1 and 37*b*1, and therefore t1 is substituted for t2. The output time of the signal caused by the connecting portions 37*a*1 and 37*b*1 is thus corrected by using the previous output time. Consequently a normal signal wave form as shown in FIG. 7(*a*) is obtained, and an erroneous detection of the moving speed is prevented.

Furthermore, the signal output caused by the first connecting portion 37*a*1 is corrected using the signal output of the first detecting target 37*a*, and the signal output caused by the second connecting portion 37*b*1 is corrected using the signal output of the second detecting target 37*b*. As a result, the problem does not occur wherein the moving speed of both edges of the endless belt 31 cannot be detected.

Returning to FIG. 5, the description of the correcting process will be continued. After the moving speeds V1 and V2 at the side edges of the endless belt 31 have been detected in the correcting process (S3), an ink discharging process is performed (S4). In the ink discharging process, ink discharge time is determined on the basis of the moving speeds V1 and V2 at the side edges of the endless belt 31 which were detected by the first and second detectors 37A and 37B. The control of the ink discharging process will be described with reference to FIGS. 8, 9, and 10.

Figure 8:
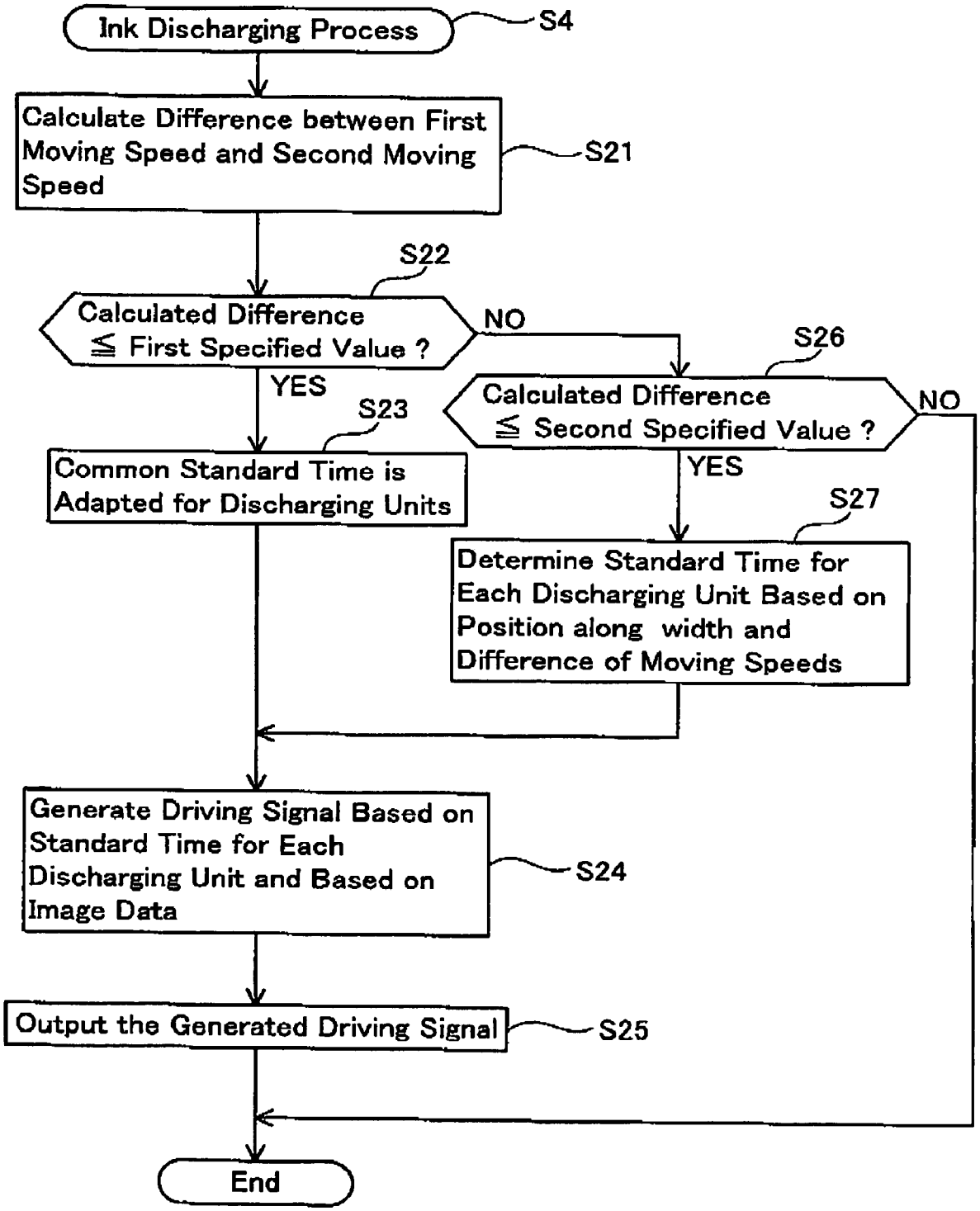
FIG. 8 shows a flow chart of an ink discharging process.
Figure 9:
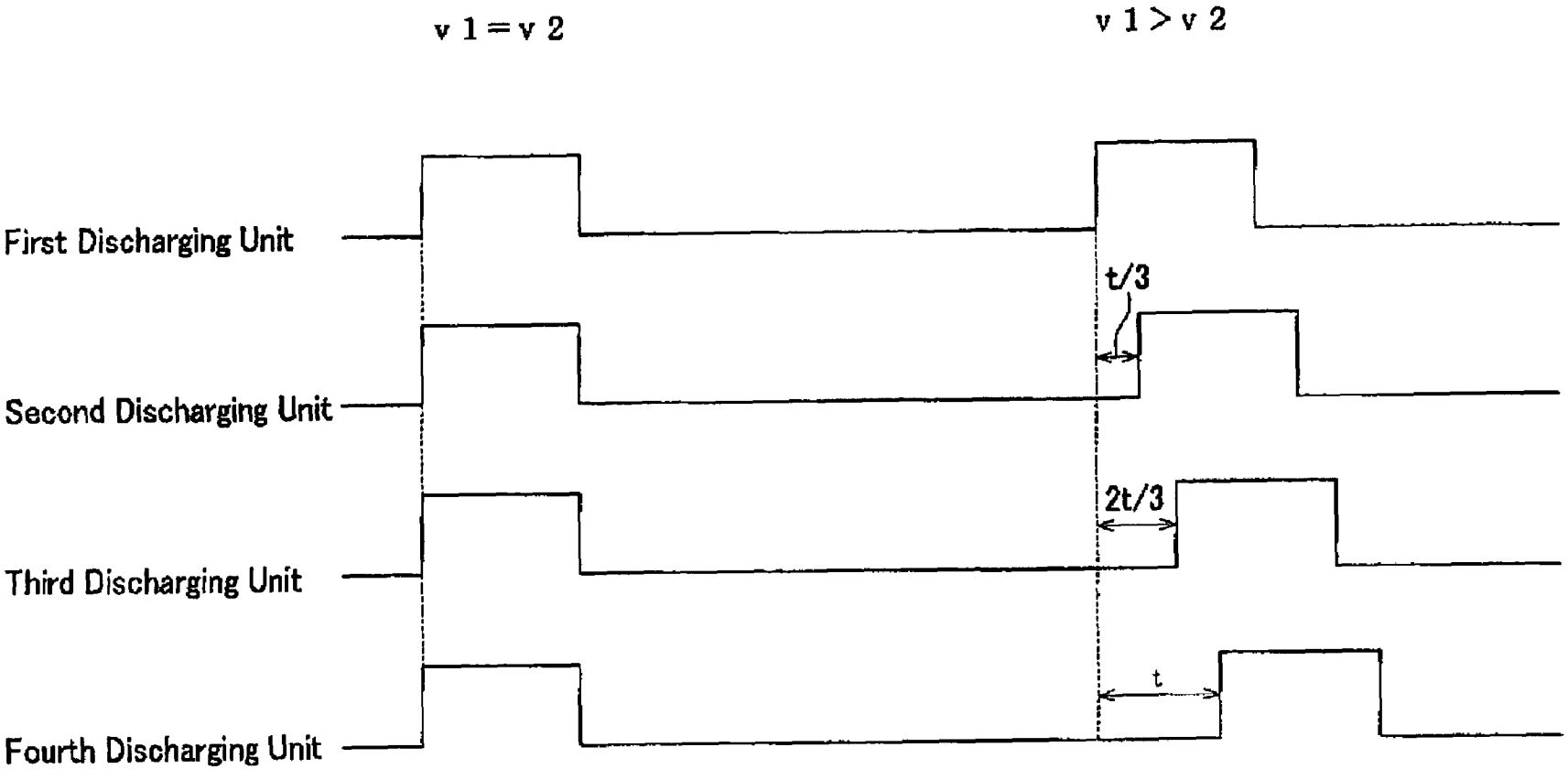
FIG. 9 shows ink discharge time of discharging units.

FIG. 8 shows a flow chart of the ink discharging process. FIG. 9 shows an example in which the ink discharge time of the discharging units 4*a*, 4*b*, 4*c*, and 4*d* (see FIG. 3) has been determined on the basis of the moving speeds V1 and V2 at the first and second positions.

As shown in FIG. 8, in the ink discharging process, the difference is first calculated between the moving speeds V1 and V2 detected by the first and second detectors 37A and 37B at the first and second positions respectively (S21). The difference in moving speeds is caused by non-uniformity of the thickness of the endless belt 31, a discrepancy in the size of the rollers 32*a* and 32*b* (see FIG. 1), etc.

Next, it is determined whether the difference in moving speeds that has been calculated is less than or equal to a first specified value (S22). In the case where the difference in moving speeds that has been calculated is less than or equal to the first specified value, i.e. if the moving speed of the endless belt 31 is approximately the same in the widthwise direction (S12: Yes), it is not necessary to alter standard time (to be described) on the basis of the widthwise position of the nozzles, and a common standard time for the discharging units 4*a*, 4*b*, 4*c*, and 4*d* is determined (S23). The first specified value is stored beforehand in the ROM 62 (see FIG. 2). However, a configuration is also possible in which the user sets the first specified value using the operating panel 68 (see FIG. 2). The user can thus select an image quality that corresponds to his usage aims.

Next, the driving signal is generated (S24). This driving signal is determined on the basis of the standard time that has been determined for the discharging units 4*a*, 4*b*, 4*c*, and 4*d*, and on the basis of the image data stored in the image memory 71 (see FIG. 2). The driving signal determines the time at which the ink will be discharged from each of the nozzles, and causes the ink to be discharged at the ink discharge time that has been determined. The driving signal that has been generated is transmitted to the bead driver 65 (see FIG. 2), and the head driver 65 transmits the driving signal to actuators that drive the nozzles. Each nozzle discharges the ink at the ink discharge time that has been determined for that nozzle. The ink discharging process thus ends.

In the case where, in the process of S22, it is determined that the difference in moving speeds that has been calculated is greater than the first specified value, i.e. if a significant difference is confirmed between the moving speeds V1 and V2 at the first and second positions, it is predicted that the printing sheet 22 being fed by the endless belt 31 will become inclined. In this case, it is necessary to correct the inclination of the printing sheet 22 by correcting the ink discharge time in accordance with the position of the nozzles in the widthwise direction. In this case, it is determined whether the difference between the moving speeds V1 and V2 is less than or equal to a second specified value (S26). If the difference between the moving speeds V1 and V2 is greater than the second specified value (S26: No), it is predicted that the inclination of the printing sheet 22 will become too great, it is determined that it is difficult to perform the printing operation, and the ink discharging process ends. In this case, it is preferred that an error message is displayed on the operating panel 68 and that the user is informed by sounding an alarm from a speaker (not shown). The user can thus realize rapidly that the printing process is not being performed normally.

Alternatively, in the case where, in the process of S26, it is determined that the difference between the moving speeds V1 and V2 that has been calculated is less than or equal to the second specified value (S26: Yes), the ink discharge time of the discharging units 4*a*, 4*b*, 4*c*, and 4*d* is corrected in accordance with the difference between the moving speeds.

The determination of the discharge time of the discharging units 4*a*, 4*b*, 4*c*, and 4*d* will be described with reference to FIG. 9. Here, the case will be proposed in which, as in the example of FIG. 4, data for printing a pattern parallel with an upper edge 22*a* of the printing sheet 22 is being stored in the image memory 71.

If the moving speeds V1 and V2 at both side edges of the endless belt 31 are equal, the rows of nozzles are parallel with an upper edge 22*a*-1 of the printing sheet 22, as shown by the broken line in FIG. 4, and it is not necessary to correct the ink discharge time in accordance with the position of the nozzles in the widthwise direction. As shown on the left side of FIG. 9, in the case where V1 and V2 are equal, ink is discharged simultaneously from the discharging units 4*a*, 4*b*, 4*c*, and 4*d*.

Alternatively, as shown on the right side of FIG. 9, in the case where v2 is slower than v1, the upper edge 22*a*-2 of the printing sheet 22, as shown by the solid line in FIG. 4, is inclined with respect to the rows of nozzles. In this case, in order to cancel out the effects of the inclination, the discharge time of the second discharging unit 4*b* is delayed by t/3 with respect to the discharge time of the first discharging unit 4*a*, the discharge time of the third discharging unit 4*c* is delayed by 2t/3 with respect to the discharge time of the first discharging unit 4*a*, and the discharge time of the fourth discharging unit 4*d* is delayed by t. The time t is calculated on the basis of the difference between the moving speeds V1 and V2 at the first and second positions, and from the distance between the first and second positions. The greater the difference between the moving speeds V1 and V2, the greater the time t.

A standard speed V0 is stored in the ROM 61 of the ink jet printer 1. If V0=V1>V2, the discharge time of the first discharging unit 4*a* is calculated from the standard speed V0, the discharge time of the second discharging unit 4*b* is delayed by t/3, the discharge time of the third discharging unit 4*c* is delayed by 2t/3, and the discharge time of the fourth discharging unit 4*d* is delayed by t. If V1>V2=V0, the discharge time of the fourth discharging unit 4*d* is calculated from the standard speed V0, the discharge time of the third discharging unit 4*c* is accelerated by t/3, the discharge time of the second discharging unit 4*b* is accelerated by 2t/3, and the discharge time of the first discharging unit 4*a* is accelerated by t.

In the case where the standard speed V0 is between V1 and V2, and in the case where V2 is slower than V1, the discharge time of the first and second discharging units 4*a* and 4*b* is accelerated with respect to the standard speed V0, and the discharge time of the third and fourth discharging units 4*c* and 4*d* is delayed with respect to the standard speed V0.

Figure 10:
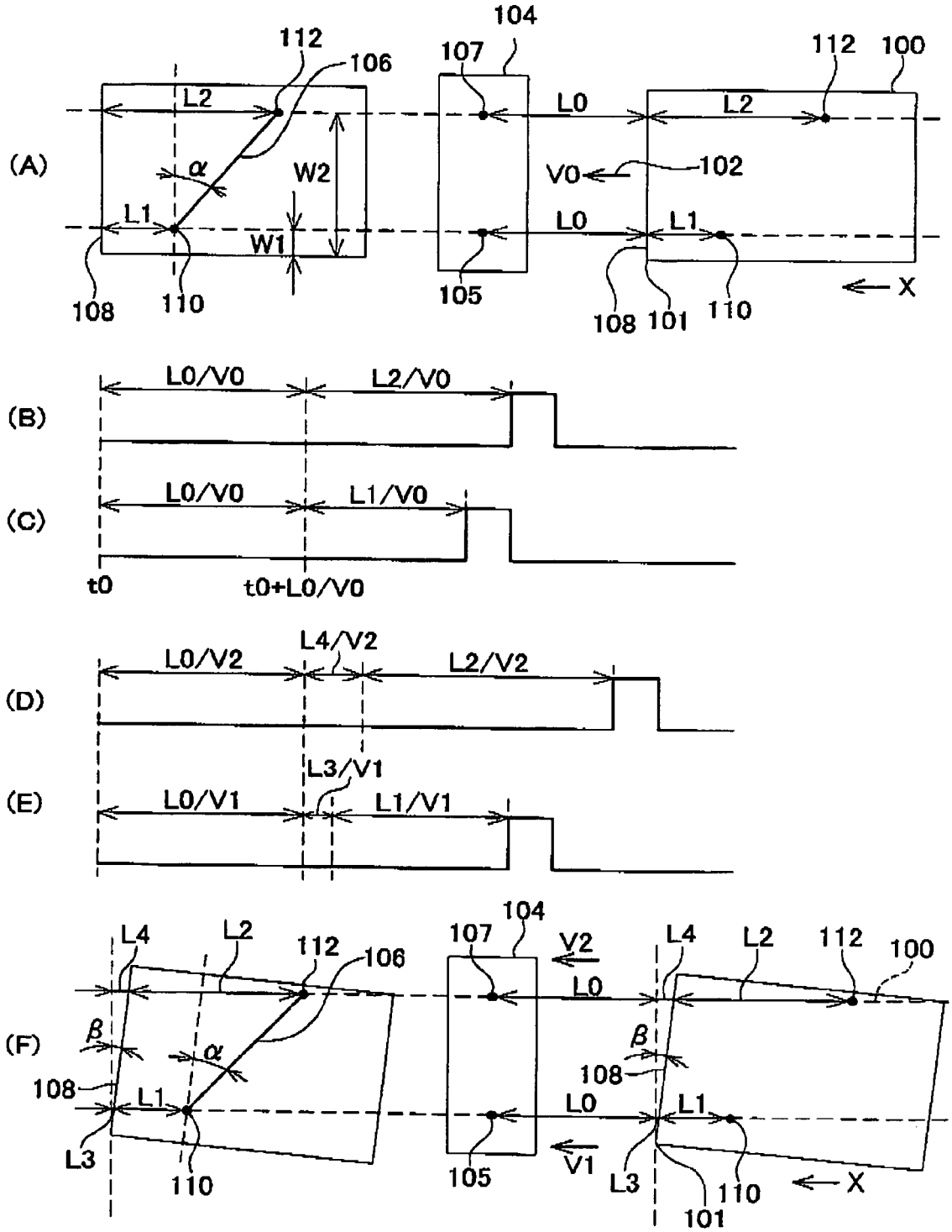
FIG. 10(A) to (F) shows a process of determining standard time, and a process of determining ink discharge time.

FIG. 10 shows a case where a line segment 106 is printed that is inclined at an angle α with respect to an upper edge 108 of a printing sheet 100. In FIG. 10, the case is shown where the ink discharge time of nozzles at widthwise positions W1 and W2 will be determined. A nozzle 105 at the widthwise position W1 must discharge ink onto a point 110 separated by a distance L1 from the upper edge 108 of the printing sheet 100. A nozzle 107 at the widthwise position W2 must discharge ink onto a point 112 separated by a distance L2 from the upper edge 108 of the printing sheet 100. The position of the point 110 is shown by the paper sensor 36: when the upper edge 108 of the printing sheet 100 reaches the position of the paper sensor 36, the paper sensor 36 reverses its output. The time t0 in FIG. 10(B) to (E) represents the time when the paper sensor 36 reverses its output when the upper edge 108 of the printing sheet 100 reaches a point 101. The distance in the longitudinal direction (the direction of movement of the endless belt) from the point 101 to a row where the nozzles 105, 107 are disposed is L0.

FIG. 10(A) shows the case where the moving speed of the endless belt is the same in the widthwise direction, and the endless belt is moving at the standard speed V0. The sheet 100 is not inclined. In this case, the upper edge 108 of the printing sheet 100 arrives directly below the nozzles 105 and 107 at the time when L0/V0 has elapsed since the time t0. The time point at which the upper edge 108 of the printing sheet 100 arrives directly below the nozzles 105 and 107 is termed the standard time. If the sheet 100 is not inclined, the standard time is common to both the nozzles 105 and 107. In the case of (A), if the nozzle 105 of the widthwise position W1 discharges ink with a time such that L1/V0 has elapsed since the standard time t0+L0/V0, as shown in (C), the ink can be discharged onto the point 110 separated from the upper edge 108 of the printing sheet 100 by the distance L1. If the nozzle 107 of the widthwise position W2 discharges ink with a time such that L2/V0 has elapsed since the standard time t0+L0/V0, as shown in (B), the ink can be discharged onto the point 112 separated from the upper edge 108 of the printing sheet 100 by the distance L2. The line segment 106 can thus be printed that is inclined at the angle α with respect to the upper edge 108 of the printing sheet 100.

FIG. 10(F) shows an example of a case where the moving speed at the upper side edge of the endless belt is V2, and the moving speed at the lower side edge of the endless belt is V1, and V1>V2. In this case, the sheet 100 that is being fed on the endless belt becomes inclined while being fed. In (F), an example is shown where the sheet has been inclined by an angle β. With respect to a straight line extending across the widthwise direction of the endless belt, the upper edge 108 of the printing sheet 100 is separated therefrom by a distance L3 at the location of the widthwise position W1, and the upper edge 108 of the printing sheet 100 is separated therefrom by a distance L4 at the widthwise position W2.

In this case, the upper edge 108 of the printing sheet 100 does not arrive directly below the nozzle 105 when L0/V1 has elapsed since the time t0. The upper edge 108 of the printing sheet 100 does not arrive directly below the nozzle 105 until L3/V1 has further elapsed. The standard time for the upper edge 108 of the printing sheet 100 to arrive directly below the nozzle 105 is not t0+L0/V1, but is instead t0+L0/V1+L3/V1. Similarly, the upper edge 108 of the printing sheet 100 does not arrive directly below the nozzle 107 even when L0/V2 has elapsed since the time t0. The upper edge 108 of the printing sheet 100 does not arrive directly below the nozzle 107 until L4/V1 has further elapsed. The standard time for the upper edge 108 of the printing sheet 100 to arrive directly below the nozzle 107 is not t0+L0/V2, but is instead t0+L0/V2+L4/V2. The standard time at which the upper edge 108 of the printing sheet 100 arrives directly below the nozzles must thus be corrected across the widthwise direction.

The pattern can be printed on the inclined sheet by adding a time period calculated from the pattern to be printed to the aforementioned corrected standard time. As shown in (E), if the nozzle 105 of the widthwise position W1 discharges ink with a time such that L1/V1 has elapsed since the standard time t0+L0/V1+L3/V1, ink can be discharged onto the point 110 separated by the distance L1 from the upper edge 108 of the printing sheet 100. As shown in (D), if the nozzle 107 of the widthwise position W2 discharges ink with a time such that L2/V2 has elapsed since the standard time t0+L0/V2+L4/V2, ink can be discharged onto the point 112 separated by the distance L2 from the upper edge 108 of the printing sheet 100. The line segment 106, which is inclined at the angle α, can be printed with respect to the upper edge 108 of the printing sheet 100 that is inclined by the angle β.

In the present embodiment, the moving speed V1 at the first position and the moving speed V2 at the second position are detected and the estimated sheet inclination angle β is predicted from the difference in speed. The relationship between the difference in speed and the angle of inclination β is stored in the ROM 61. When the angle of inclination β has been determined, the standard time at which the upper edge of the sheet will arrive directly below the nozzles is determined. The standard time differs according to the position along the widthwise direction of the endless belt. When the standard time has been determined, this is made into the standard, and the actual discharge time is decided. At this step, the discharge time is determined on the basis of the pattern to be printed. With the present embodiment, effects caused by the inclination of the sheet are cancelled out, and printing results can be obtained that are the same as a case where a sheet is printed that is not inclined.

Figure 13:
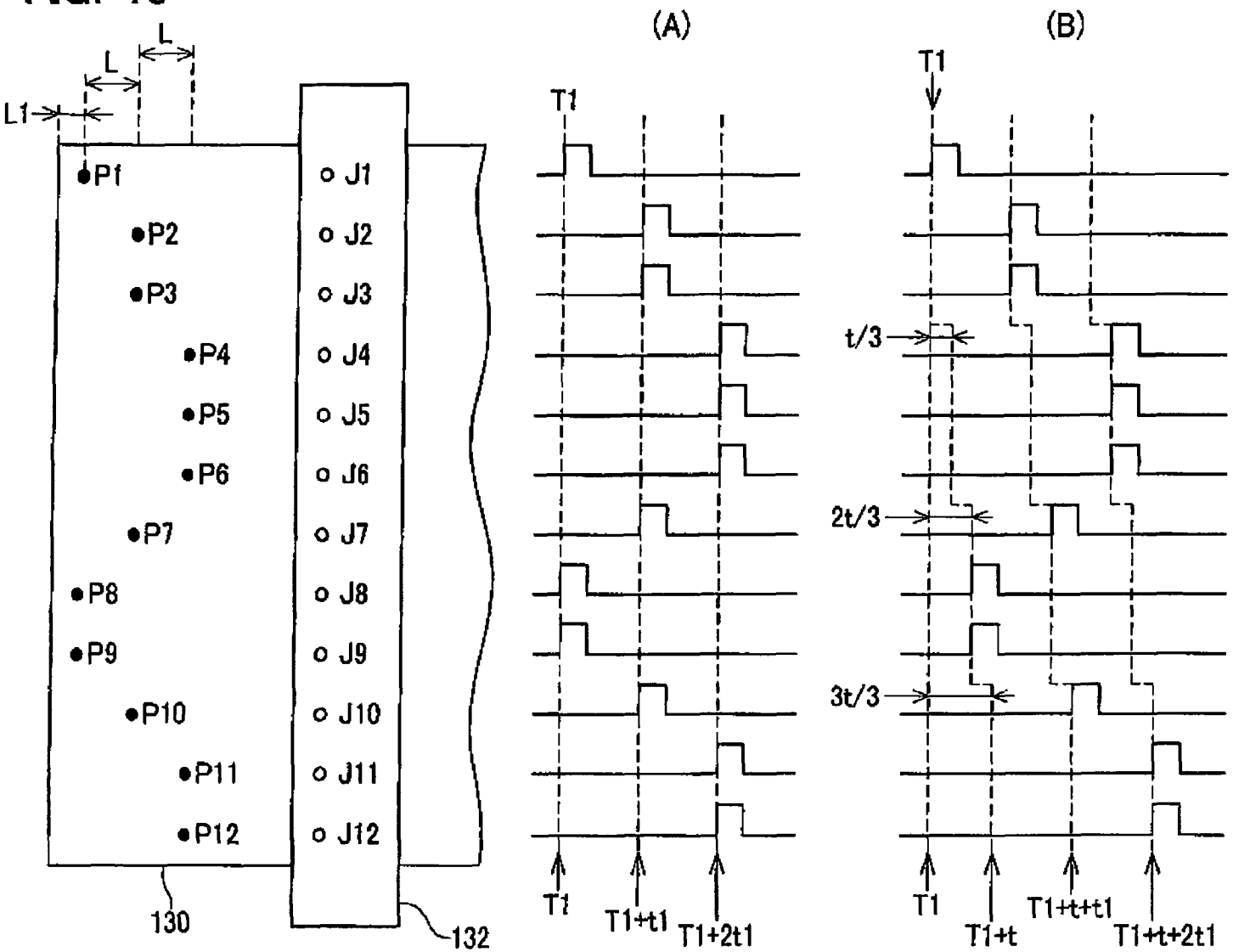
FIG. 13 shows a process of determining standard time, and a process of determining ink discharge time.

FIG. 13 shows another example for determining the ink discharge time. FIG. 13 shows a case of printing dots P1 to P12 on sheet 130 with print head 132 having nozzles J1 to J12. The dots P1, P8, and P9 are separated from a leading edge of sheet 130 by a distance L1, the dots P P3, P7 and P10 are separated from the leading edge of sheet 130 by a distance L1+L, and the dots P4, P5, P6, P11 and P12 are separated from the leading edge of sheet 130 by a distance L1+2L. (A) shows a case when there is no speed variation along the width of the endless belt. t1 is determined from the distance L and moving speed of the endless belt. (B) shows a case when there is speed variation along the width of the endless belt. t is the time required to cancel the inclination of sheet 130 and is stored within ROM 61. The large t is stored within ROM 61 when the difference between the speed V1 and V2 is large. In this embodiment, the correction of standard time is performed for each group of nozzles. FIG. 3 shows an example that the standard time for nozzles J1 to J3 is not corrected, the standard time for nozzles J4 to J6 is delayed by t/3, the standard time for nozzles J7 to J9 is delayed by 2t/3, and the standard time for nozzles J10 to J12 is delayed by t. The inclination of sheet 130 is cancelled by correcting the standard time as above.

t1 should be determined from the distance L and moving speed of the endless belt. In the case of(B), the moving speed of the endless belt is not uniform. Therefore, t1 changes depending on position along the width of the endless belt. Since the sheet 130 is further inclined while passing beneath the print head, t1 may change depending on the distance from the leading edge of sheet 130. It may be possible that the time of t1 should not be proportional with the distance from the leading edge. However, in usual cases, such an accurate correction is not required. In this case, t1 calculated in (A) may be used in (B).

FIG. 13 shows an example that the point separated from the leading edge of sheet 130 by the distance L1 is positioned directly below the nozzle at the standard time. Various positional relation-ships may be adopted to define the standard time.

Returning to FIG. 8, the description of the ink discharging process will be continued. The standard time of each discharging unit is determined in a process of S27. Next, the driving signal for printing the image data on the printing sheet 22 is generated (S24) on the basis of the standard time of the discharging units 4*a*, 4*b*, 4*c*, and 4*d* that has been determined, and on the basis of the image data stored in the image memory 71. The driving signal that has been generated is transmitted to the head driver 65 (see FIG. 2), and the head driver 65 transmits the driving signal to the actuators that drive the nozzles. Each nozzle discharges the ink at the ink discharge time that has been determined for that nozzle. The ink discharging process thus ends.

Returning to FIG. 5, the description of the printing process will be continued. After the ink discharging process of S4 has ended, it is determined whether the printing of an nth sheet has been completed (S5). If the printing has not been completed (S5: No), the correcting process (S3) and the ink discharging process (S4) are repeated, and these processes are repeated until the printing of the nth sheet has been completed. If the printing of the nth sheet has been completed (S5: Yes), 1 is added to the value of n (S6).

Next, the number "X" of printing sheets 22 to be printed is compared to the value of n (S7). If the value of n is not greater than the number "X" of printing sheets 22 to be printed (S7: No), the process is repeated from S3 to S6 in the same manner as with the first sheet. If the value of n is greater than the number "X" of printing sheets 22 to be printed (S7: Yes), all the printing sheets 22 have been printed, and the printing process ends.

Next, a second embodiment will be described with reference to FIG. 11. Whereas, in the first embodiment, the first and second detectors 37A and 37B (see FIG. 3) were linear encoders, first and second detectors 137A and 137B of the second embodiment are rotary encoders (the second detector 137B is in the shadow of the first detector 137A and is therefore not shown). Parts that are the same as in the first embodiment have the same reference numbers applied thereto, and a description thereof is omitted.

Figure 11:
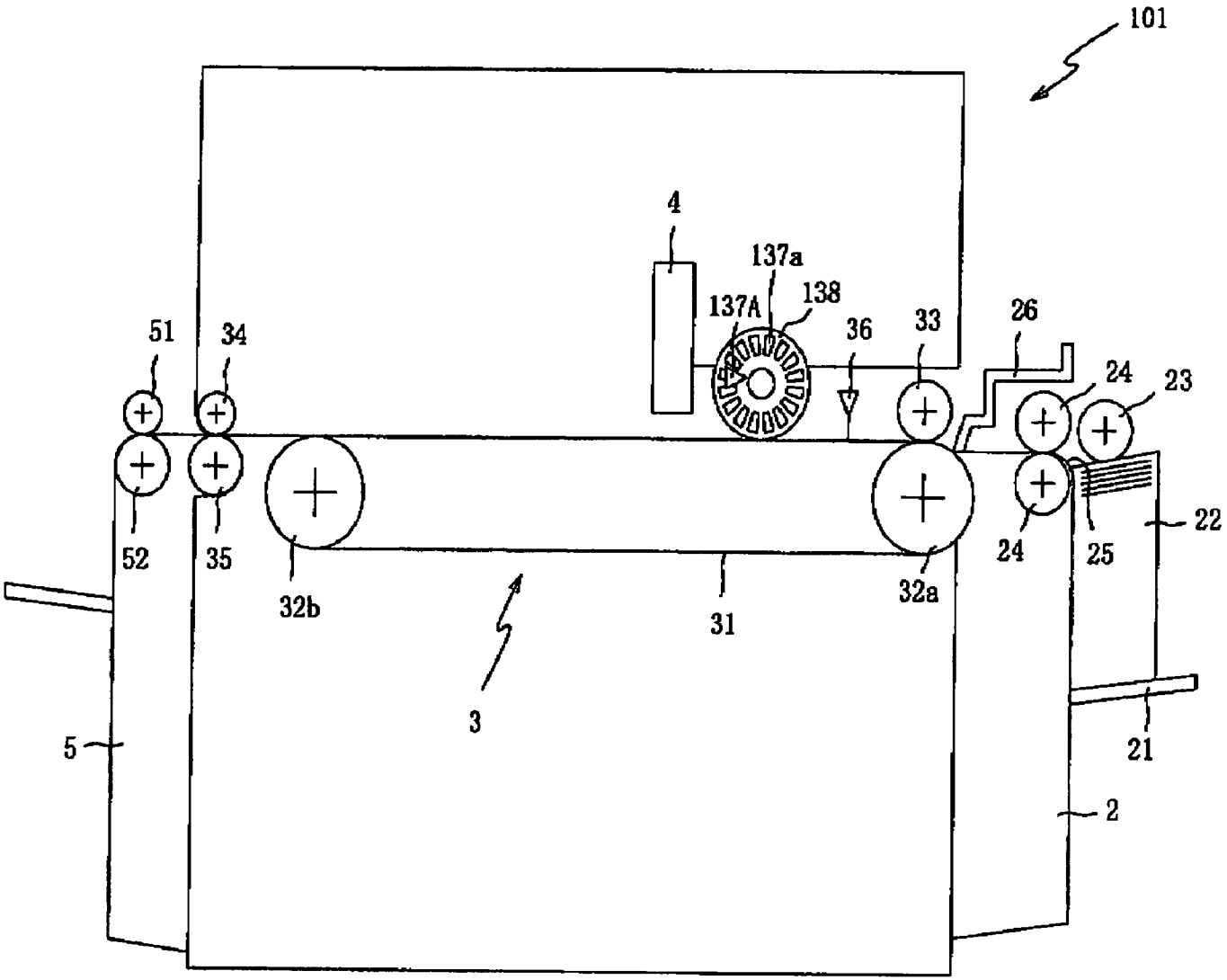
FIG. 11 shows a schematic view of an ink jet printer of a second embodiment.
Figure 12:
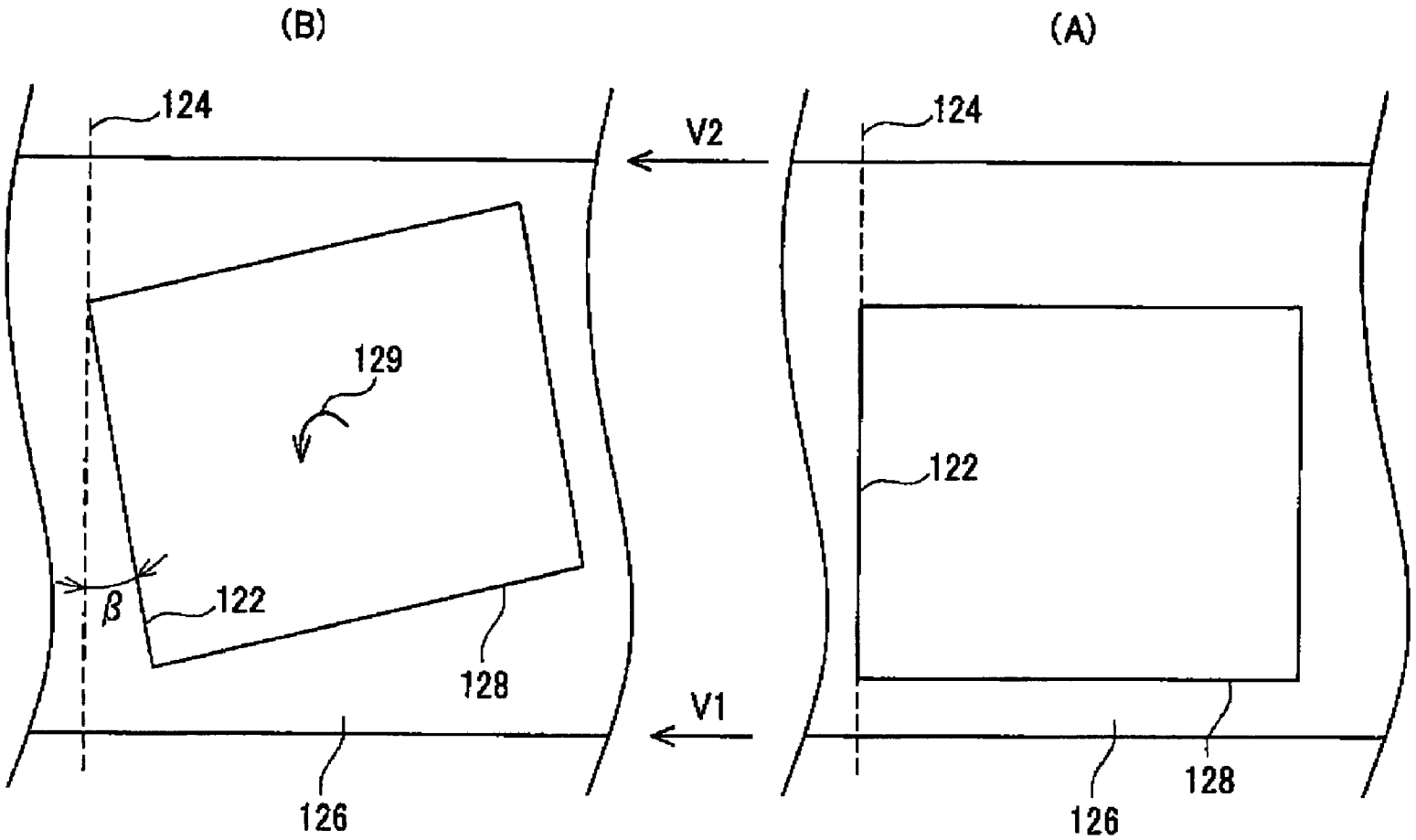
FIG. 12(A) and (B) shows the manner in which the printing sheet inclines when there is a difference in speed of the endless belt in the widthwise direction.

FIG. 11 shows a schematic view of an ink jet printer 101 of the second embodiment of the present invention. The first and second detectors 137A and 137B have a common configuration. Therefore, the appended numbers A and B will be omitted below, and a common description thereof will be given. As shown in FIG. 11, a pair of disc members 138 is supported in a main body of the ink jet printer in a manner whereby they can freely rotate. Outer peripheral faces of the disc members 138 adjoin the upper side of the outer peripheral face of the endless belt 31, and the disc members 138 rotate following the movement of the endless belt 31. Slits 137*a* that extend in a radial direction are repeated along the peripheral direction of the disc members 138. A means (not shown) for emitting and receiving light is disposed between the disc members 138. The moving speed of the endless belt 31 can be detected from the cycle with which the high/low signals output from the light receiving means is repeated. The pair of disc members 138 are disposed at both side edges, in the widthwise direction, of the endless belt 31. That is, the first and the second detectors 137A and 137B are disposed at both side edges, in the widthwise direction, of the endless belt 31. When the first and the second detecting targets 137*a* and 137*b* are used, it is not necessary to use the detecting targets 37*a* and 37*b*. As a result, the connecting portions 37*a*1 and 37*b*1 are not present, and the correcting process (S3 in FIG. 5) is not required.

Representative embodiments of the present invention have been described above. However, the present invention is not restricted to these representative embodiments. The present invention can be improved and modified in various ways without deviating from the range of the aims of the present invention.

For example, in the above described embodiment, the standard time is calculated first, and the actual ink discharge time is calculated based on the standard time and the pattern to be printed. This order may be altered. For instance, provisional ink discharge time may be calculated first based on the pattern to be printed, and the calculated provisional ink discharge time may be corrected to cancel out the inclination of the printing sheet. Both procedures will give the same result.

In the aforementioned representative embodiments, a case was described in which the first and second positions were at both sides, in the widthwise direction, of the endless belt 31. However, the positions are not limited to this example. The distance separating the first detecting target 37*a* and the second detecting target 37*b* may equally well be narrower than the width of the endless belt 31.

It is preferred that the first position and the second position are located along a straight line that extends across the width of the endless belt. In this case, it is easy to accurately predict the inclination that the printing sheet will develop due to the difference in speed.

It is preferred that the distance between the first position and the second position is longer than the maximum width of the paper that the ink jet printer can print. In this case, the first position and the second position are not covered by the paper. The moving speed of the endless belt can thus be detected at all times.

It is preferred that the width of the endless belt is greater than the maximum width of the paper that the ink jet printer can print, that the first position is at the first side edge of the endless belt, and that the second position is at the second side edge of the endless belt. In this case, a maximum difference in moving speed is detected at both widthwise edges of the endless belt, and consequently the difference in moving speed in the widthwise direction of the endless belt can be detected accurately.

It is preferred that the first position and the second position are above the outer side face of the endless belt. The moving speed of the face to which the printing sheet is adhering can thus be measured directly.

It is preferred that the plurality of ink jet nozzles disposed in the widthwise direction of the endless belt are formed into a plurality of groups in accordance with their widthwise position with respect to the endless belt, and that a standard time determiner determines the standard time for each of these groups of nozzles. In this case, the amount of calculating for correcting the discharge time is more compressed than in the case where the standard time is determined for each ink jet nozzle. The control load can thus be reduced, and control costs can be reduced.

It is preferred that the detecting targets are fixed along both side edges of the endless belt, these detecting targets changing cyclically with a predetermined pitch. It is not necessary to manufacture the detecting targets in a unitary manner with the endless belt. Manufacturing cost can thus be reduced.

It is preferred that a distinguishing device is provided that distinguishes a first signal when a connecting portion of the detecting target is detected from a second signal when a continuous portion of the detecting target is detected. A joint in the detecting target can thus be detected, and erroneous detection of the moving speed can thus be prevented.

It is preferred that the first detector maintains the value previously detected by the first detector when the first signal is detected by the first detector, and that the second detector maintains the value previously detected by the second detector when the first signal is detected by the second detector. In this case, erroneous detection of the moving speed can be prevented, and the first moving speed at the first position can be calculated from the former first moving speed at the first position, and the second moving speed at the second position can be calculated from the former second moving speed at the second position. The difference between the moving speed of the first and second positions can thus be calculated accurately.

It is preferred that an alarm is provided that sounds when the difference between the value detected by the first detector and the value detected by the second detector is larger than a predetermined amount. In the case where satisfactory printing cannot be obtained, the alarm sounds, and the user can thus be informed of that fact.

What is claimed is:

1. An ink jet printer, comprising:

an endless belt having a width;

a driving device that rotates the endless belt;

a print head having a plurality of ink jet nozzles arranged along the width of the endless belt;

a first detector that measures a moving speed of the endless belt at a first position;

a second detector that measures a moving speed of the endless belt at a second position separated from the first position along the width of the endless belt;

a paper sensor for detecting a timing when an upper edge of a printing sheet is transported to a position facing the paper sensor;

an ink discharge time determiner that determines ink discharge time for each ink jet nozzle based on a timing when the paper sensor detects the upper edge of the printing sheet, a position of the ink jet nozzle along the width of the endless belt, a difference between a value detected by the first detector and a value detected by the second detector, and a pattern to be printed; and a standard time determiner that determines standard time for each ink jet nozzle based on the position of the ink jet nozzle along the width of the endless belt and the difference between the value detected by the first detector and the value detected by the second detector, wherein the standard time is determined by the following equation:

$$t0+(L0+\beta\times W)/V$$

wherein t0 is the timing when the upper edge of the printing sheet was transported to the position facing the paper sensor, wherein L0 is a distance from the paper sensor to a row of ink nozzles, $\beta$ is a sheet inclination angle estimated by the difference between the value detected by the first detector and the value detected by the second detector, W is the position of the ink jet nozzle along the width of the endless belt, and V is the moving speed of the endless belt, and wherein the standard time for an ink jet nozzle is a timing when the upper edge of the print sheet arrives at a position below the ink jet nozzle, and wherein the ink discharge fine determiner determines the ink discharge time for each ink jet nozzle based on the standard time determine by the standard time determiner and the pattern to be printed.

2. The ink jet printer as defined in claim 1, wherein the first position and the second position are aligned on a line extending along the width of the endless belt.

3. The ink jet printer as defined in claim 2, wherein a distance between the first position and the second position is greater than a maximum width of a sheet capable of being accepted by the ink jet printer.

4. The ink jet printer as defined in claim 3, wherein the width of the endless belt is greater than the maximum width of the sheet capable of being accepted by the ink jet printer, the first position being on one side edge of the endless belt and the second point being on the other side edge of the endless belt.

5. The ink jet printer as defined in claim 4, wherein the first position and the second position are on an outer surface of the endless belt.

6. The ink jet printer as defined in claim 1, wherein the plurality of the ink jet nozzles is classified into a plurality of groups depending on the position of the ink jet nozzle along the width of the endless belt, and wherein the standard time determiner determines the standard time for each group of the ink jet nozzles.

7. The ink jet printer as defined in claim 1, further comprising:

a pair of detecting targets, each detecting target being fixed so as to extend along a side edge of the endless belt and changing cyclically with a predetermined pitch.

8. The ink jet printer as defined in claim 7, further comprising:

a distinguishing device that distinguishes a first signal when a connecting portion of the detecting target is detected from a second signal when a continuous portion of the detecting target is detected.

9. The ink jet printer as defined in claim 8, wherein the first detector maintains the value previously detected by the first detector when the first signal is detected by the first detector, and the second detector maintains the value previously detected by the second detector when the first signal is detected by the second detector.

10. The ink jet printer as defined in claim 1, further comprising:

an alarm that is activated when the difference between the value detected by the first detector and the value detected by the second detector is larger than a predetermined amount.

11. An ink jet printer comprising:

an endless belt having a width;

a driving device that rotates the endless belt;

a print head having a plurality of ink jet nozzles arranged along the width of the endless belt;

a first detector that measures a moving speed of the endless belt at a first position;

a second detector that measures a moving speed of the endless belt at a second position separated from the first position along the width of the endless belt;

a paper sensor for detecting a timing when an upper edge of a printing sheet is transported to a position facing the paper sensor;

an ink discharge time determiner that determines ink discharge time for each ink jet nozzle based on a timing when the paper sensor detects the upper edge of the printing sheet, a position of the ink jet nozzle along the width of the endless belt, a difference between a value detected by the first detector and a value detected by the second detector, and a pattern to be printed;

a pair of detecting targets, each detecting target being fixed so as to extend along a side edge of the endless belt and changing cyclically with a predetermined pitch; and a distinguishing device that distinguishes a first signal when a connecting portion of the detecting target is detected from a second signal when a continuous portion of the detecting target is detected, wherein the first detector maintains the value previously detected by the first detector when the first signal is detected by the first detector, and the second detector maintains the value previously detected by the second detector when the first signal is detected by the second detector.

* * * * *

UNITED STATES PATENT AND TRADEMARK OFFICE

CERTIFICATE OF CORRECTION

PATENT NO. : 7,448,715 B2
APPLICATION NO. : 11/245220
DATED : November 11, 2008
INVENTOR(S) : Koji Nakayama It is certified that error appears in the above-identified patent and that said Letters Patent is hereby corrected as shown below:

On the Title Page, item 57, Line 7:
Please delete “belt” and insert --of the endless belt--

In Column 19, Claim 1, Line 35:
Please delete “of ink nozzles” and insert --of the ink jet nozzles--

In Column 19, Claim 1, Line 45:
Please delete “fine” and insert --time--

In Column 19, Claim 1, Line 47:
Please delete “determine” and insert --determined--

Signed and Sealed this

Fourteenth Day of July, 2009

John Doll

JOHN DOLL
*Acting Director of the United States Patent and Trademark Office*